US011957233B2

(12) United States Patent
Kalck et al.

(10) Patent No.: US 11,957,233 B2
(45) **Date of Patent: *Apr. 16, 2024**

(54) SELF-ADJUSTABLE CARRYING STRAP SYSTEM AND METHODS TO MANUFACTURE SELF-ADJUSTABLE CARRYING STRAP SYSTEM

(71) Applicant: KARSTEN MANUFACTURING CORPORATION, Phoenix, AZ (US)

(72) Inventors: Christopher E. Kalck, Phoenix, AZ (US); John A. Loudenslager, Phoenix, AZ (US)

(73) Assignee: KARSTEN MANUFACTURING CORPORATION, Phoenix, AZ (US)

( * ) Notice: Subject to any disclaimer, the term of this patent is extended or adjusted under 35 U.S.C. 154(b) by 3 days.

This patent is subject to a terminal disclaimer.

(21) Appl. No.: 18/460,439

(22) Filed: Sep. 1, 2023

(65) Prior Publication Data

US 2023/0404243 A1 Dec. 21, 2023

Related U.S. Application Data

(63) Continuation of application No. 18/196,115, filed on May 11, 2023, which is a continuation of application (Continued)

(51) Int. Cl.

| | |
|---|---|
| ***A45F 3/04*** | (2006.01) |
| ***A45F 3/14*** | (2006.01) |
| ***A63B 55/00*** | (2015.01) |

(52) U.S. Cl.

CPC ..... *A45F 3/047* (2013.01); *A45F 3/14* (2013.01); *A63B 55/00* (2013.01); *A63B 55/408* (2015.10);

(Continued)

(58) Field of Classification Search

CPC . A41F 11/00; A41F 3/04; A41H 37/08; A44B 11/006; A44B 11/02; A44B 11/04; A44B 11/22; A45F 2003/146; A45F 3/04; A45F 3/047; A45F 3/14; A45F 5/02; A45F 5/021; A63B 2225/09; A63B 55/00; A63B 55/008; A63B 55/408; Y10T 24/3916; Y10T 29/49826

(Continued)

(56) References Cited

U.S. PATENT DOCUMENTS

| | | | |
|---|---|---|---|
| 425,173 | A | 4/1890 | Gutmann |
| 687,919 | A | 12/1901 | Fairbrother, Jr. |

(Continued)

FOREIGN PATENT DOCUMENTS

| | | | |
|---|---|---|---|
| EP | 0650677 | A2 | 5/1995 |
| WO | 2005030001 | A1 | 4/2005 |

OTHER PUBLICATIONS

International Search Report for Application No. GB1209210.2 dated Jul. 2, 2012.

*Primary Examiner* — Nathan J Newhouse
*Assistant Examiner* — Matthew T Theis

(57) ABSTRACT

Embodiments of bag having a self-adjustable carrying strap system and methods to manufacture such a bag are generally described herein. Other embodiments that may be described and claimed include a golf bag having a self-adjustable carrying strap system.

12 Claims, 28 Drawing Sheets

Related U.S. Application Data

No. 14/610,221, filed on Jan. 30, 2015, now Pat. No. 11,771,206, which is a continuation-in-part of application No. 13/173,041, filed on Jun. 30, 2011, now abandoned.

(60) Provisional application No. 61/478,391, filed on Apr. 22, 2011.

(52) U.S. Cl.
CPC ..... *A45F 2003/146* (2013.01); *A63B 2225/09* (2013.01); *Y10T 24/3916* (2015.01); *Y10T 29/49826* (2015.01)

(58) Field of Classification Search
USPC .... 2/230; 224/192, 257, 259, 264, 578, 579, 224/600, 627; 24/169, 186, 196, 197, 24/315, 31 B, 31 R, 33 F, 35, 570; D11/218
See application file for complete search history.

(56) References Cited

U.S. PATENT DOCUMENTS

| | | | | |
|---|---|---|---|---|
| 1,213,386 | A | 1/1917 | Lamothe | |
| 1,288,170 | A | 12/1918 | Pick | |
| 1,501,066 | A | 7/1924 | Rutherford | |
| 1,697,363 | A | 1/1929 | Losey | |
| 1,855,007 | A | 4/1932 | Bradley | |
| 2,835,010 | A | 5/1958 | Bayon | |
| 3,739,961 | A | 6/1973 | Soukeras | |
| 4,757,927 | A | 7/1988 | Rutty | |
| 4,764,962 | A | 8/1988 | Ekman et al. | |
| 5,016,797 | A | 5/1991 | Rowledge | |
| 5,038,984 | A | 8/1991 | Izzo | |
| 5,042,703 | A | 8/1991 | Izzo | |
| 5,042,704 | A | 8/1991 | Izzo | |
| 5,421,614 | A | 6/1995 | Zheng | |
| 5,490,620 | A | 2/1996 | Bergqvist | |
| 5,593,077 | A | 1/1997 | Izzo | |
| D411,039 | S | 6/1999 | Reimers et al. | |
| D411,666 | S | 6/1999 | Reimers et al. | |
| D412,396 | S | 8/1999 | Reimers et al. | |
| D413,019 | S | 8/1999 | Reimers | |
| 6,006,974 | A | 12/1999 | Varney et al. | |
| 6,152,342 | A | 11/2000 | Suk | |
| 6,305,535 | B1 | 10/2001 | Fair | |
| 6,530,129 | B1 | 3/2003 | Cheng | |
| 7,131,534 | B2 | 11/2006 | Enes | |
| 7,318,542 | B2 | 1/2008 | Godshaw et al. | |
| 7,387,226 | B2 | 6/2008 | Porter | |
| 7,857,181 | B2 | 12/2010 | Sacks | |
| 9,044,651 | B2 | 6/2015 | Campbell et al. | |
| D810,443 | S | 2/2018 | Burgess et al. | |
| 11,395,536 | B2 | 7/2022 | Pacha et al. | |
| 11,771,206 | B2 * | 10/2023 | Kalck | A45F 3/14 224/259 |
| 2007/0278264 | A1 | 12/2007 | Chesal et al. | |
| 2010/0170065 | A1 | 7/2010 | Paik | |
| 2023/0276926 | A1 * | 9/2023 | Kalck | A63B 55/408 224/259 |

* cited by examiner

SELF-ADJUSTABLE CARRYING STRAP SYSTEM AND METHODS TO MANUFACTURE SELF-ADJUSTABLE CARRYING STRAP SYSTEM

CROSS-REFERENCE TO RELATED APPLICATIONS

This is a continuation application that claims benefit to U.S. patent application Ser. No. 18/196,115, which is a continuation application, filed on May 11, 2023, that claims benefit to U.S. patent application Ser. No. 14/610,221, which is a continuation-in-part application, filed on Jan. 30, 2015, that claims benefit to U.S. Non-Provisional application Ser. No. 13/173,041, filed on Jun. 30, 2011, which claims benefit to U.S. Provisional Application No. 61/478,391, filed on Apr. 22, 2011, which are herein incorporated by reference in their entirety.

FIELD

The present disclosure relates to an adjustable carrying strap system for bags, and in particular for golf bags.

BACKGROUND

Most golf bags may be in the form of a tubular fabric or leather container having a generally cylindrical configuration with a closed bottom end and an open top end through which golf clubs are inserted into and removed from the golf bag. Although golf bags are manufactured in a variety of sizes and materials so as to better suit various intended uses, golf bags are conventionally grouped into two basic classes. The first class of golf bags are generally larger and heavier golf bags designed to be carried by a pull cart or transported by a golf cart, while the second class of golf club bags are generally smaller and lighter golf bags designed to be carried by the individual during play.

In particular, the second class of golf bags are usually referred to as "carry bags" which are carried by the individual using a carrying strap arrangement that may be used to lift and carry the golf bag. Many carrying bags have a carrying strap arrangement consisting of either one or two carrying straps for lifting and carrying the golf bag on the individual's shoulders. In particular, a carrying strap arrangement having a pair of carrying straps may be arranged such that the first carrying strap crosses over the second carrying strap along a buckle that engages both carrying straps in a crossing fashion. This crossing arrangement using the buckle allows each carrying strap to be engaged to a respective shoulder of the individual when carrying the golf bag. Typically, the buckle defines a plurality of slots arranged to require each carrying strap be threaded through the buckle to permit one carrying strap to cross over the other carrying straps, which restrains, prevents or pinches the carrying straps from moving as the individual carries the golf bag. As such, periodic adjustment of one or more carrying straps may be required when the golf bag shifts as the individual carries the golf bag, thereby requiring the individual to place the golf bag down in order to manually adjust the carrying straps. However, manual adjustment of the carrying straps can be cumbersome and time consuming as the individual may need to place the golf bag down and take the time to make the necessary adjustments to the carrying straps.

BRIEF DESCRIPTION OF THE DRAWINGS

Corresponding reference characters indicate corresponding elements among the various views of the drawings. The headings used in the figures should not be interpreted to limit the scope of the claims.

DETAILED DESCRIPTION

As described herein, a bag having a self-adjustable carrying strap system and methods of manufacturing such a bag with the self-adjustable carrying strap system is configured and arranged to allow the carrying straps (generally described as a first strap and a second strap) of the bag to automatically adjust without requiring manual intervention by the individual. The self-adjustable carrying strap system contains a connector plate that has two channels configured to receive the first strap and further define a traverse space between the first and second channel for receiving the second strap. The connector plate is configured to avoid pinching or clasping the first and/or second straps. Rather, the first and second straps overlap each other to allow the straps to move freely without hindrance along the connector plate as items shift in the bag or as the bag moves relative to an individual carrying the bag. As a result, the straps may be adjusted without manual intervention. The bag may be any bag attached to the self-adjustable carrying strap system, such as a golf bag for carrying golf clubs.

Figure 1:
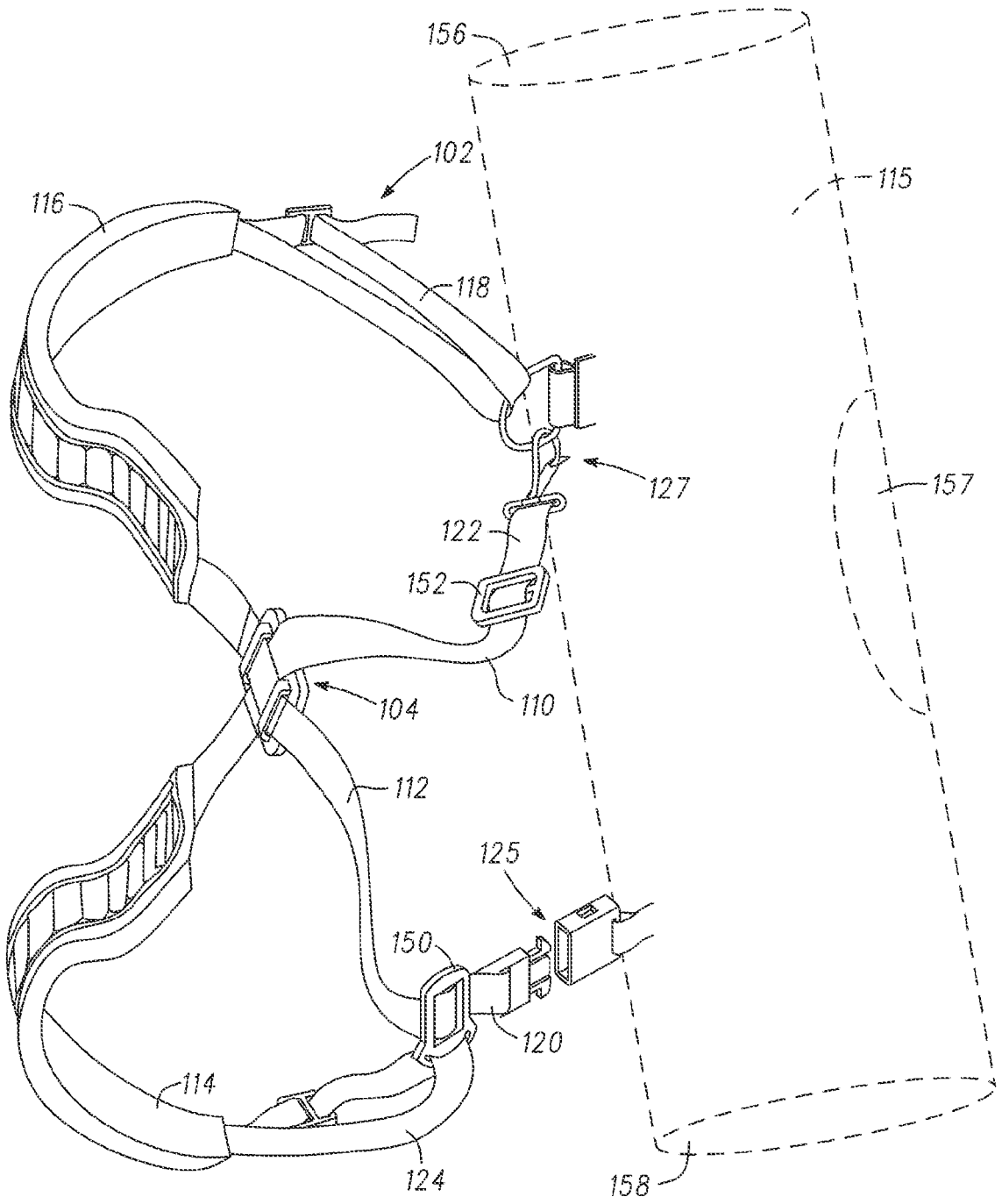
FIG. 1 is a perspective view of a bag coupled to a first embodiment of a self-adjustable carrying strap system.
Figure 2:
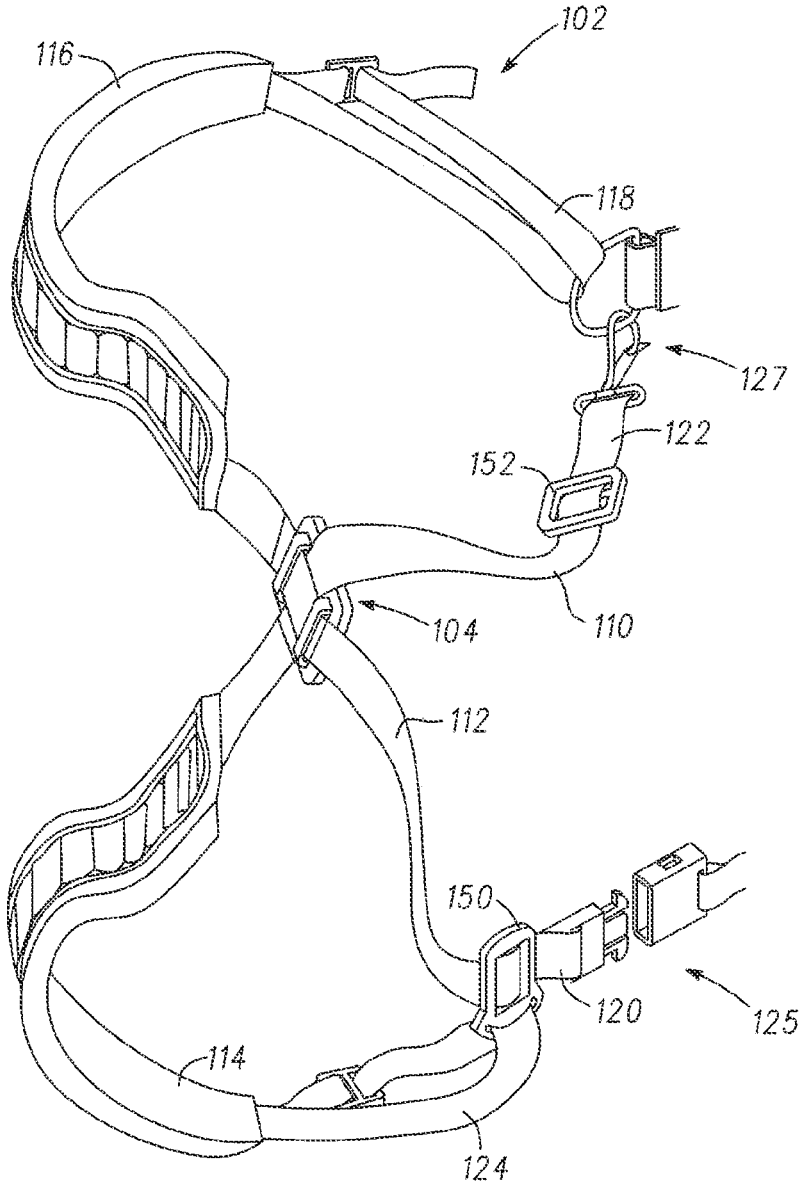
FIG. 2 is a perspective view of the self-adjustable carrying strap system having a first carrying strap, a second carrying strap and a connector plate.
Figure 4:
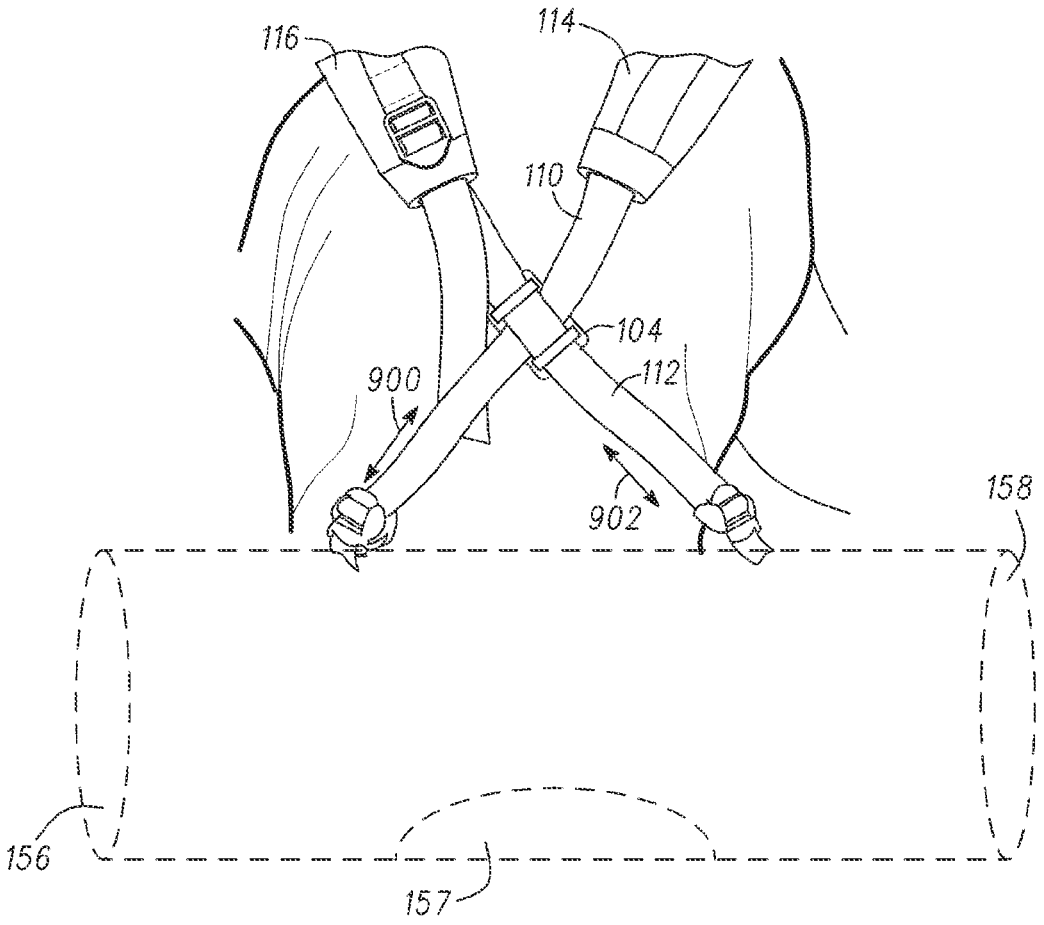
FIG. 4 is a perspective view of the bag with the self-adjustable carrying strap system engaged to an individual.

Referring to the FIG. 1, a first embodiment of the self-adjustable carrying strap system 102 is connected to a bag 115 that may contain weighted objects. The self-adjustable carrying strap system 102 includes a first carrying strap 110 and a second carrying strap 112 that overlap each other in a crossing fashion along a connector plate 104. The connector plate 104 is configured to allow the first and second carrying straps 110 and 112 to be self-adjustable relative to each other without any manual adjustment required by the individual such that the first and second carrying straps 110 and 112 freely move relative to each other along either axis 900 for the first carrying strap 110 or axis 902 for the second carrying strap 112 in response to the shifting of the bag 115 as shown in FIG. 4.

In some embodiments, the first carrying strap 110 may include a first shoulder pad 114 and the second carrying strap 112 may include a second shoulder pad 116 to provide a cushioning effect as the individual carries the bag 115. In some embodiments, the first carrying strap 110 may include a first buckle 152 that allows the individual to adjust the length of the first carrying strap 110, while the second carrying strap 112 may include a second buckle 150 that also allows the individual to adjust the length of the second carrying strap 112.

In some embodiments, proximal portions 122 and 118 of the first and second carrying straps 110 and 112, respectively, may be engaged together at a first connector arrangement 127 to connect the first and second carrying straps 110 and 112 adjacent or proximate to the first end 156 of the bag 115. Similarly, the distal portions 124 and 120 of the first and second carrying straps 110 and 112, respectively, may be engaged together at a second connector arrangement 125 to connect the first and second carrying straps 110 and 112 adjacent or proximate to a third portion 158 of the bag 115. The distal portions 124 and 120 of the first and second carrying straps 110 and 112 may be engaged together at a second connector arrangement 125 to connect the first and second carrying straps 110 and 112 opposite to the second end 157 of the bag 115. However, in other embodiments the proximal portions 122 and 118 and distal portions 124 and 120 of the first and second carrying straps 110 and 112 may be separately connected to the bag 115 using additional connector arrangements 125 and 127. In one aspect, the first and second connector arrangements 125 and 127 may be a ring and loop arrangement, an independent buckle, a hook fastener arrangement, and a snap-fit connector arrangement.

Referring to FIGS. 4, 6-11, the connector plate 104 is a modular component that may be added after-market to an existing bag 115. The connector plate 104 is configured to permit the first and second carrying straps 110 and 112 to overlap each other along the connector plate 104 and move relative to each other without manual intervention when the bag 115 shifts as it is being carried or as the bag 115 changes position relative to an individual carrying the bag 115. The connector plate 110 includes a connector body 105 defined by a front surface 128 and a rear surface 130 having a first side 136, second side 138, third side 140 and fourth side 142 that collectively form a generally rectangular shape. In some embodiments, the first and second sides 136 and 138 may have a substantially straight configuration, while the third and fourth sides 140 and 142 may have generally curved or tapered configuration. In some embodiments, first, second third and fourth sides 136, 138, 140 and 142 may have a symmetrical configuration, an asymmetrical or tapered configuration, or a combination symmetrical and asymmetrical or tapered configuration, although the apparatus, articles of manufacture, and methods described herein are not limited in this regard. For example, the connector plate body 105 may have a square configuration, a circular configuration, an oval configuration, and a rectangular configuration. As further shown, the connector plate 104 includes a first bridge portion 132 and a second bridge portion 134 in parallel orientation that define a transverse space 131 in the area of the connector plate body 105 between the first and second bridge portions 132 and 134. The first and second bridge portions 132 and 134 may be engaged or integral with the connector plate body 105.

Figure 6:
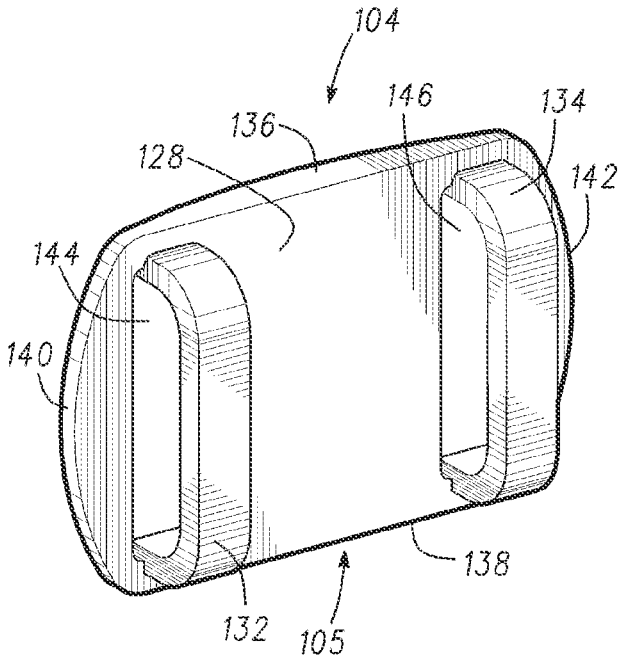
FIG. 6 is an elevated perspective front view of the connector plate.

The first and second bridge portions 132 and 134 define first and second channels 144 and 146, respectively, above the plane 804 configured to receive the first or second carrying straps 110 or 112 when inserted through the first and second channels 144 and 146. As shown in FIG. 6, the first and second channels 144 and 146 are aligned to define a first pathway along a longitudinal axis 800, while the transverse space 131 is aligned to define a second pathway along a latitudinal axis 802. The first pathway along longitudinal axis 800 and the second pathway along latitudinal axis 802 may be in transverse orientation to each other in a crossing configuration. In addition, the first pathway along longitudinal axis 800 may be configured to receive the first carrying strap 110, while the second pathway along latitudinal axis 802 may be configured to receive the second carrying strap 112 so that the first carrying strap 110 crosses over and overlaps the second carrying strap 112 when engaged to the connector plate 104. In other embodiments, the first pathway along longitudinal axis 800 may receive the second carrying strap 112, while the second pathway along latitudinal axis 802 may receive the first carrying strap 110.

Figure 11:
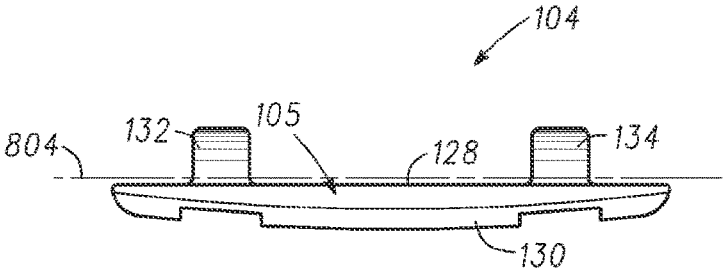
FIG. 11 is an end view of the connector plate.
Figure 12:
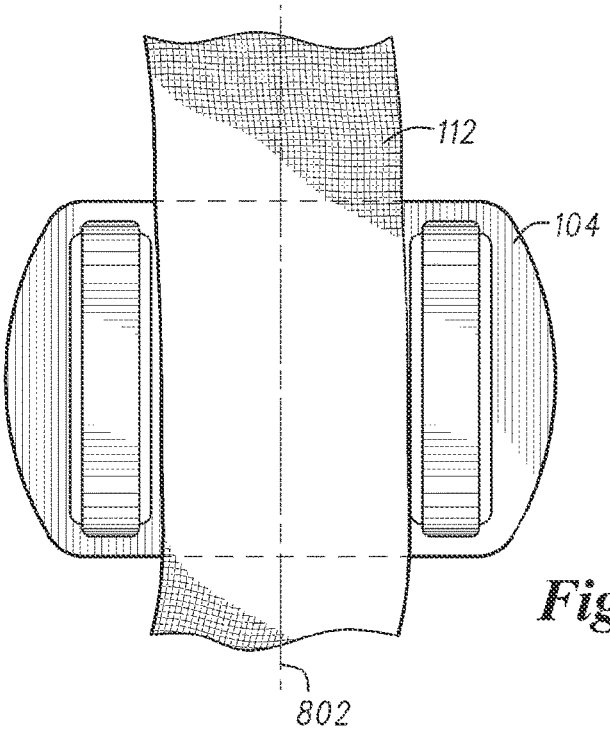
FIG. 12 is a front view of the first carrying strap received between the first and second channels of the connector plate.

Referring to FIG. 12, a plane 804 is defined adjacent or proximate to the front surface 128 of the connector plate body 105 and extends in parallel fashion to the first pathway along longitudinal axis 800 and the second pathway along latitudinal axis 802. When the first carrying strap 110 crosses over the second carrying strap 112 along the connector plate 104, both the first and second carrying straps 110 and 112 are disposed adjacent or proximate to plane 804 (FIG. 11).

Figure 7:
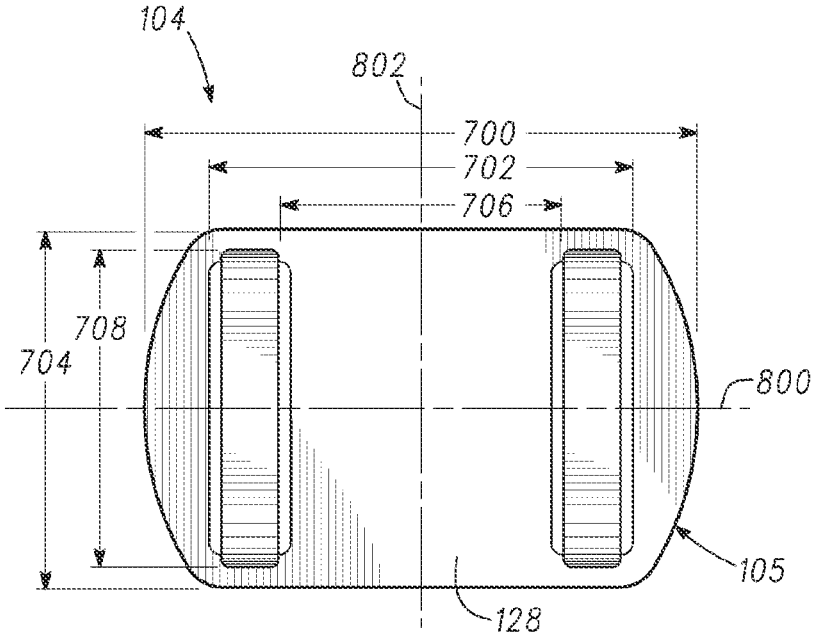
FIG. 7 is a front view of the connector plate.
Figure 8:
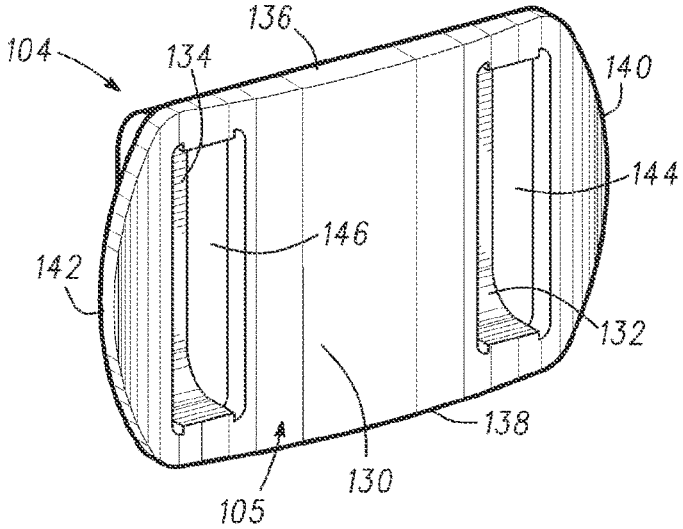
FIG. 8 is an elevated perspective rear view of the connector plate.
Figure 9:
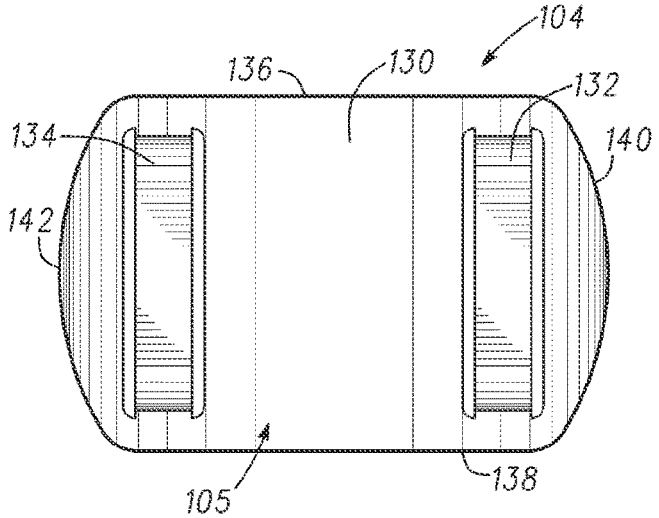
FIG. 9 is a rear view of the connector plate.
Figure 10:
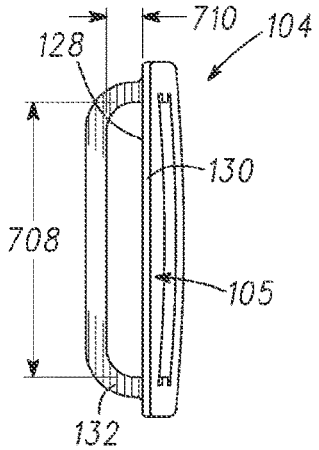
FIG. 10 is a side view of the connector plate.
Figure 13:
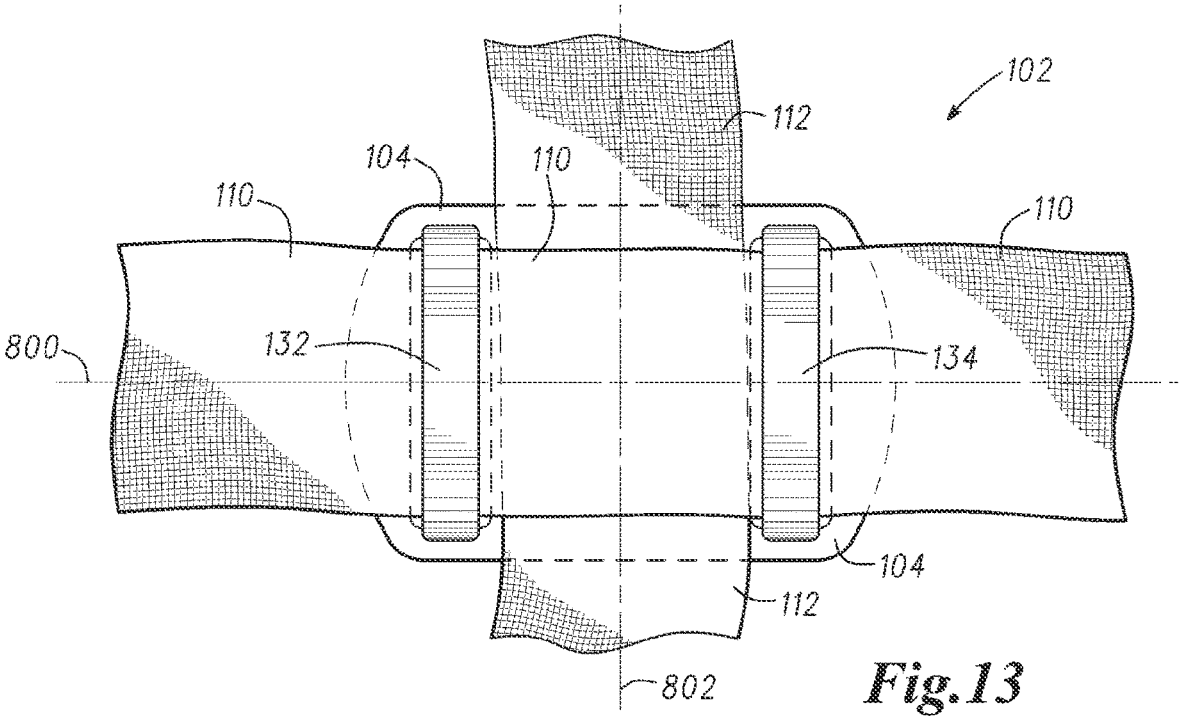
FIG. 13 is a front view of the second carrying strap inserted through the first and second channels and overlapping the first carrying strap along the connector plate.

As shown in FIGS. 7 and 10, the connector plate 104 may have an outer length 700 of 60 mm corresponding to the overall length of the connector body 105, an inner length 702 of approximately 41 mm corresponding to the length of the first and second sides 136 and 138, a length 704 of approximately 40 mm corresponding to the length of the third and fourth sides 140 and 142, a length 706 of approximately 23 mm corresponding to the length between the first and second bridge portions 132 and 134, and a length 708 of approximately 35 mm corresponding to the length of the first and second raised channels 132 and 134. In addition, as shown in FIG. 10, the first bridge portion 132 as well as the second bridge portion 134 may have a height 710 of approximately 7 mm. In some embodiments, the range of dimensions for the connector plate body 105 may include a length 700 between 50 mm to 70 mm, a length 702 between 35 mm to 45 mm, a length 706 between 35 mm and 45 mm, a length 708 between 30 mm to 40 mm, a height 710 of between 5 mm and 10 mm. In FIG. 13, the dimensions of the first pathway along longitudinal axis 800 and the second pathway along axis 802 are configured to receive the first and second bridge portions 132 and 134, respectively.

The bag 115 may be able to carry or transport weighted objects. The weighted objects may be any item that can fit into the bag 115 including, but not limited to, golf clubs including iron-type golf clubs, wood-type golf clubs, and putter-type golf clubs, books, supplies, clothes, carpentry tools, architect tools, bowling ball, survey tools, computers and computer related accessories, papers, documents, art supplies, weapons, shoes, and food supplies. The bag 115 may be in any configuration or shape as long as it is connected to the self adjustment carrying strap system 102. In some embodiments, the bag 115 may be generally a golf bag, an elongated duffle bag, a backpack, a bowling bag, a backpack, a computer bag, a rucksack, or a suitcase. As illustrated in FIG. 1, the bag 115 may define an first upper portion 156, a second middle portion 157, and a third lower portion 158 relative to the self adjustment carrying strap system 102.

The bag 115 may be made from a variety of materials, such as leather, synthetic rubber, neoprene, polyethylene, polyurethane, acrylonitrile butadiene styrene, plastic, fabric material, or combinations thereof. In addition, the first and second carrying straps 110 and 112 may also be made from a variety of materials, such as leather, synthetic rubber, neoprene, polyethylene, polyurethane, acrylonitrile butadiene styrene, plastic, fabric material, or combinations thereof. The apparatus, articles of manufacture, and methods described herein are not limited in this regard.

Figure 3:
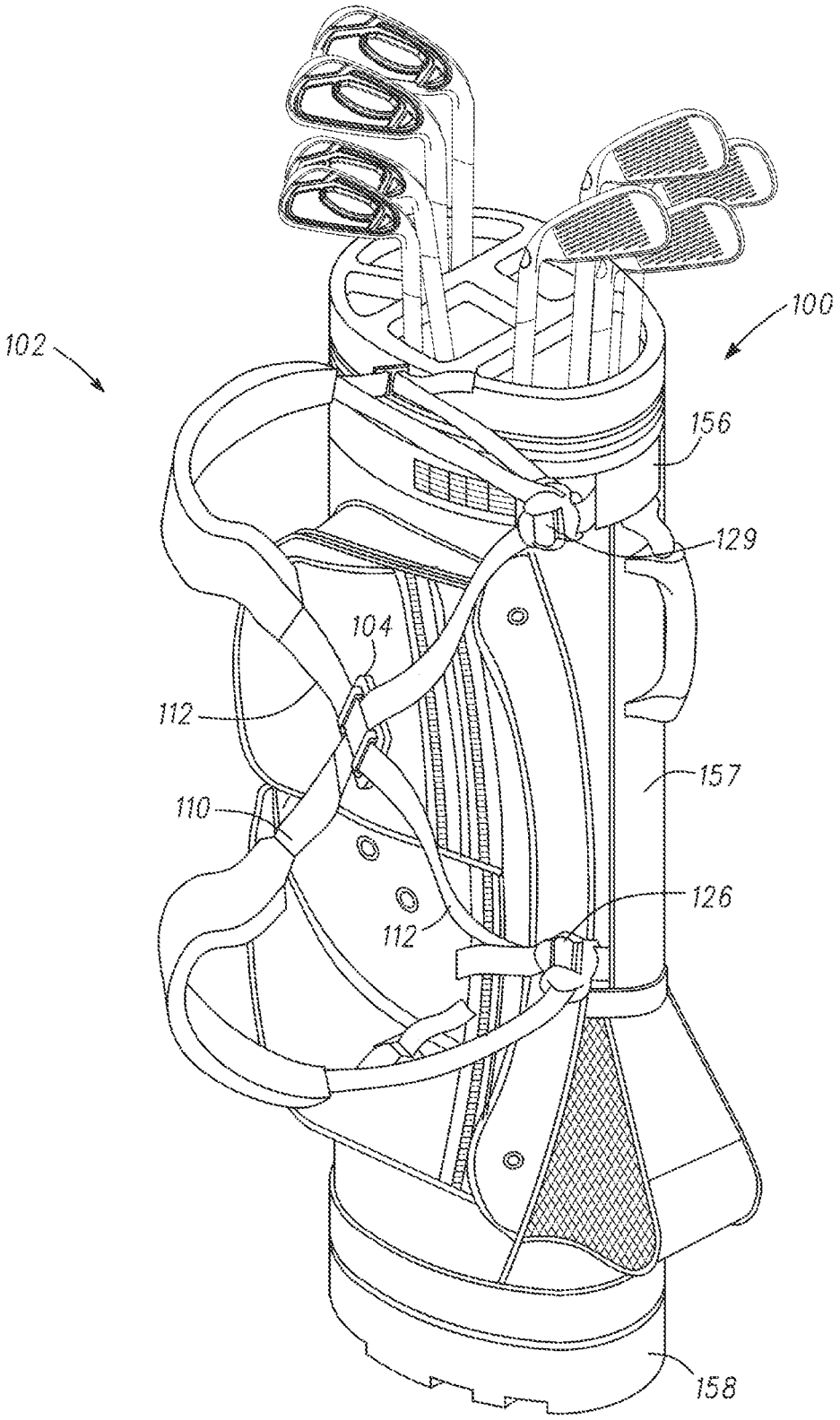
FIG. 3 is a perspective view of a golf bag coupled to the self-adjustable carrying strap system.
Figure 5:
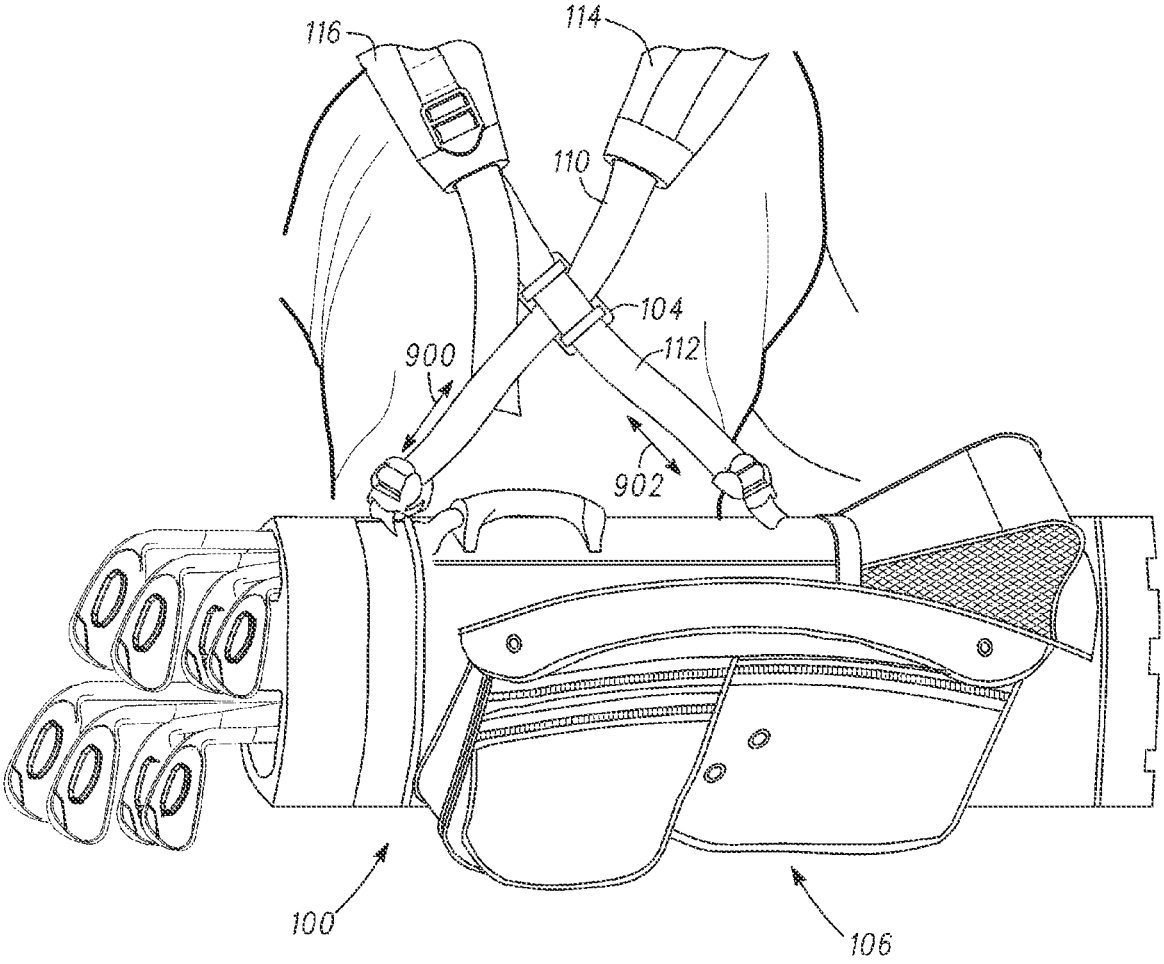
FIG. 5 is a perspective view of the golf bag with the self-adjustable carrying strap system engaged to an individual.

An embodiment of the golf bag is illustrated and generally indicated as 100 in FIGS. 3 and 5. In general, the golf bag 100 includes a generally tubular elongated body 106 defining the first upper portion 156, a second lower portion 158, and third middle portion 157. In one embodiment, the golf bag 100 is a carrying bag that is adapted to be carried by an individual. The golf bag 100 further includes the self-adjustable carrying strap system 102 having a first carrying strap 110 and a second carrying strap 112 that overlap each other in a crossing fashion along the connector plate 104. The connector plate 104 of the golf bag is configured to allow the first and second carrying straps 110 and 112 to be self-adjustable without any manual adjustment required by the individual such that the first and second carrying straps 110 and 112 freely move relative to each other along either axis 900 for the first carrying strap 110 or axis 902 for the second carrying strap 112 in response to the shifting of the golf bag 100 as shown in FIG. 5.

In some embodiments, the first carrying strap 110 may include a first shoulder pad 114 and the second carrying strap 112 may include a second shoulder pad 116 to provide a cushioning effect as the individual carries the golf bag 100. In some embodiments, the first carrying strap 110 may include a first buckle 150 that allows the individual to adjust the length of the first carrying strap 110, while the second carrying strap 112 may include a second buckle 152 that also allows the individual to adjust the length of the second carrying strap 112.

In some embodiments, the proximal portions 118 and 122 of the first and second carrying straps 110 and 112, respectively, may be engaged together at a first connector arrangement 125 to connect the first and second carrying straps 110 and 112 adjacent or proximate to the first upper portion 156 of the golf bag 100. Similarly, the distal portions 120 and 124 of the first and second carrying straps 110 and 112, respectively, may be engaged together at a second connector arrangement 127 to connect the first and second carrying straps 110 and 112 adjacent or proximate to the second lower portion 158 of the golf bag 100. However, in other embodiments the proximal portions 118 and 122 and distal portions 120 and 124 of the first and second carrying straps 110 and 112 may be separately connected to the golf bag 100 using additional connector arrangements 125 and 127. In one aspect, the first and second connector arrangements 125 and 127 may be a ring and loop arrangement, independent buckle, hook fastener arrangement, and snap-fit connector arrangement. Referring to FIGS. 6-10 as discussed above, the connector plate 104 is configured to permit the first and second carrying straps 110 and 112 to overlap each other along the connector plate 104 and move relative to each other without manual intervention when the golf bag 100 shifts as it is being carried.

Figure 14:
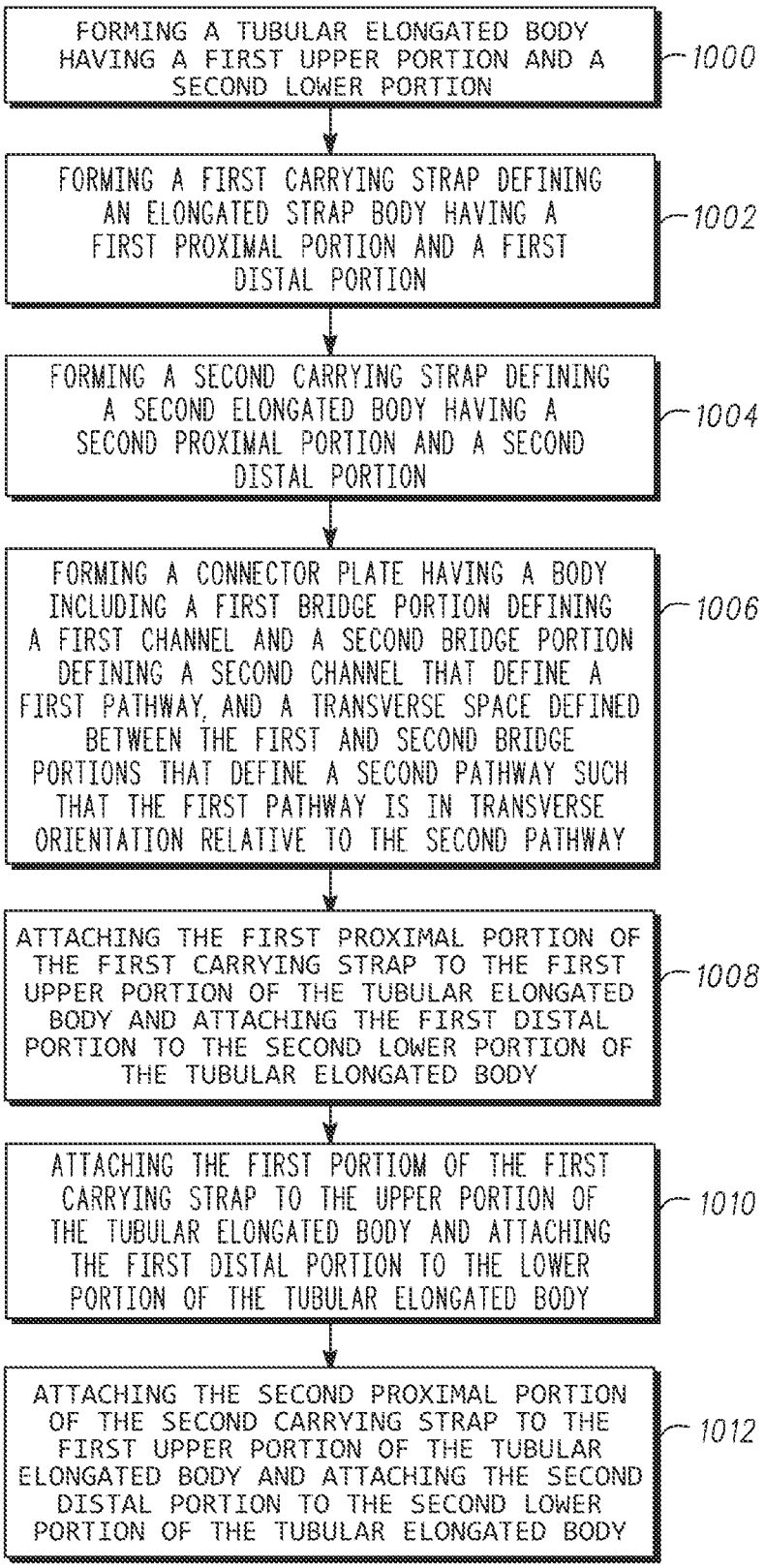
FIG. 14 is a flow chart illustrating a method for manufacturing the golf bag having the self-adjustable carrying strap system.

A method of manufacturing the bag 115 with the self-adjustable carrying strap system 102 is also illustrated in FIGS. 12-14. Referring to FIGS. 1 and 14, at block 1000 forming the tubular elongated body 106 having a first upper portion 156 and a second lower portion 157. At block 1002, forming a first carrying strap 110 having a first proximal portion 122 and a first distal portion 124. At block 1004, forming a second carrying strap 112 defining a first proximal portion 118 and a second distal portion 120. At block 1006, forming a connector plate 104 having a connector plate body 105 including the first bridge portion 132 defining the first channel 144 and the second bridge portion 134 defining the second channel 146 in which the first and second bridge portions 132 and 134 are in parallel orientation to one another as well as adjacent or proximate to the same plane 804 as the front surface 128 of the connector plate body 105. In addition, the first and second bridge portions 132 and 134 collectively define a first pathway and a transverse space 131 defined between the first and second bridge portions 132 and 134 that define the second pathway such that the first pathway is in transverse orientation relative to the second pathway. At block 1008, the second carrying strap 112 is positioned along the first pathway and the first carrying strap 110 is inserted through the first and second channels 144 and 146 and positioned along the second pathway. In this intersecting arrangement, the first carrying strap 110 and the second carrying strap 112 overlap each other in a transverse orientation. At block 1010, attaching the first proximal portion 122 of the first carrying strap 110 to the upper portion 156 of the bag 115 and attaching the first distal portion 124 to the lower portion 158 of the bag 115. At block 1012, attaching the second proximal portion 118 of the second carrying strap 112 to the upper portion 156 of the bag and attaching the second distal portion 120 to the lower portion 158 of the bag 115. In addition, the first and second carrying straps 110 and 112 may move freely relative to each other such that each respective first and second carrying strap 110 and 112 automatically adjusts without manual intervention by the individual whenever the bag 115 shifts as the individual is carrying the bag 115. In one embodiment, the connector plate body 105 may be formed using a molding process, a stamping process, a milling process, and a combination thereof. In some embodiments, the connector plate body 105 maybe made from a plastic, metal, or a composite material. The method of manufacture described above may be used to manufacture the golf bag 100 with the self-adjustable carrying strap system 102 as illustrated in FIGS. 12-14.

Figure 15:
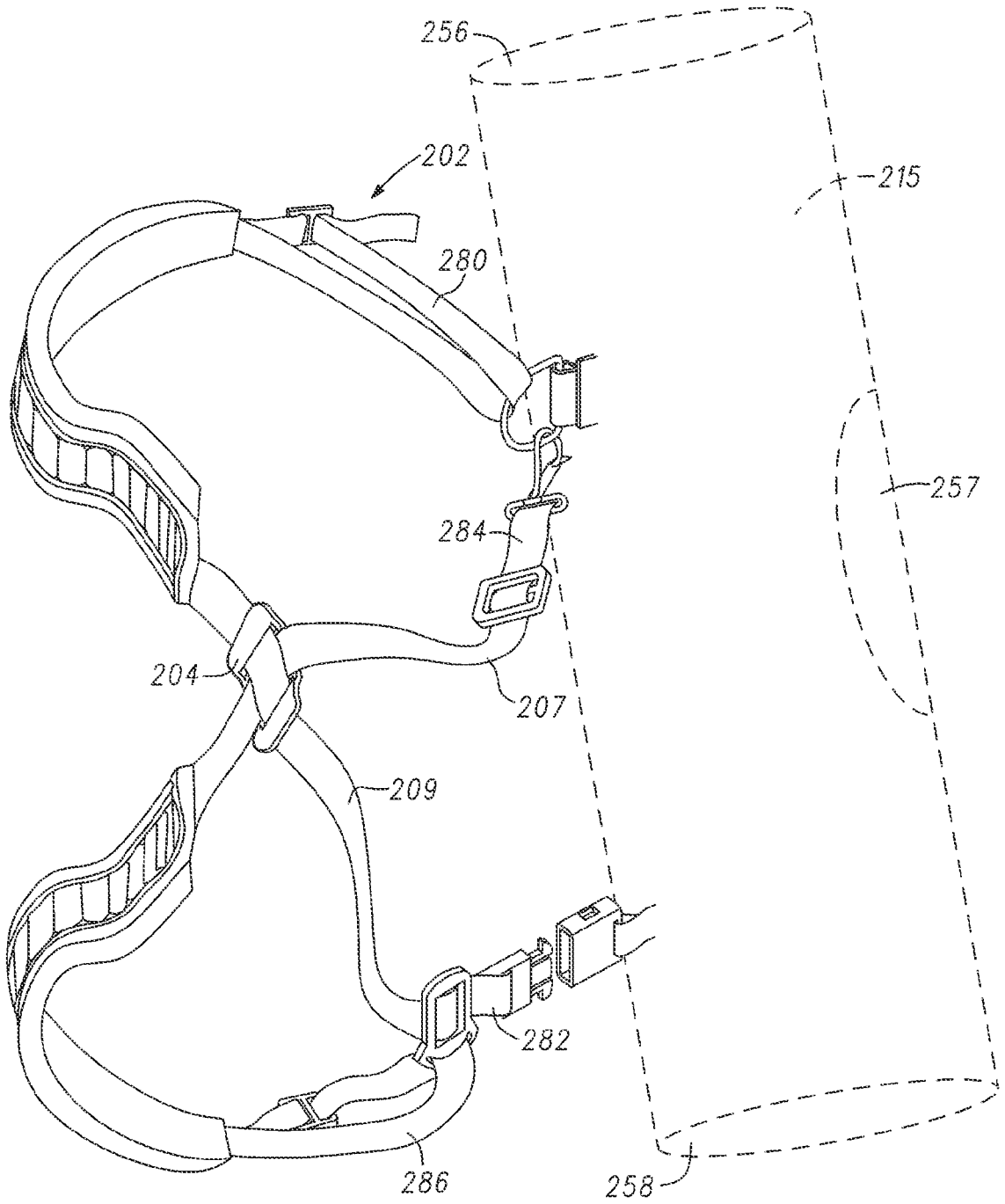
FIG. 15 is a perspective view of a bag coupled to a second embodiment of the self-adjustable carrying strap system.
Figure 16:
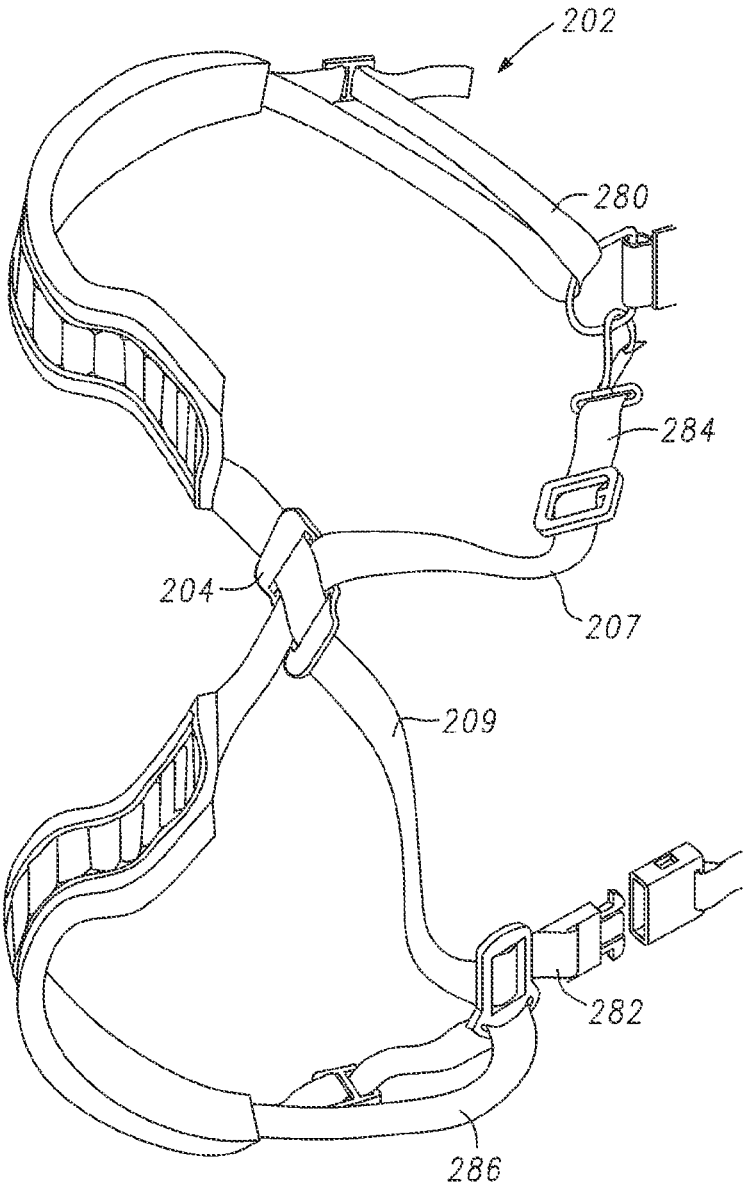
FIG. 16 is a perspective view of the self-adjustable carrying strap system of FIG. 15 having a first carrying strap, a second carrying strap and a connector plate.
Figure 17:
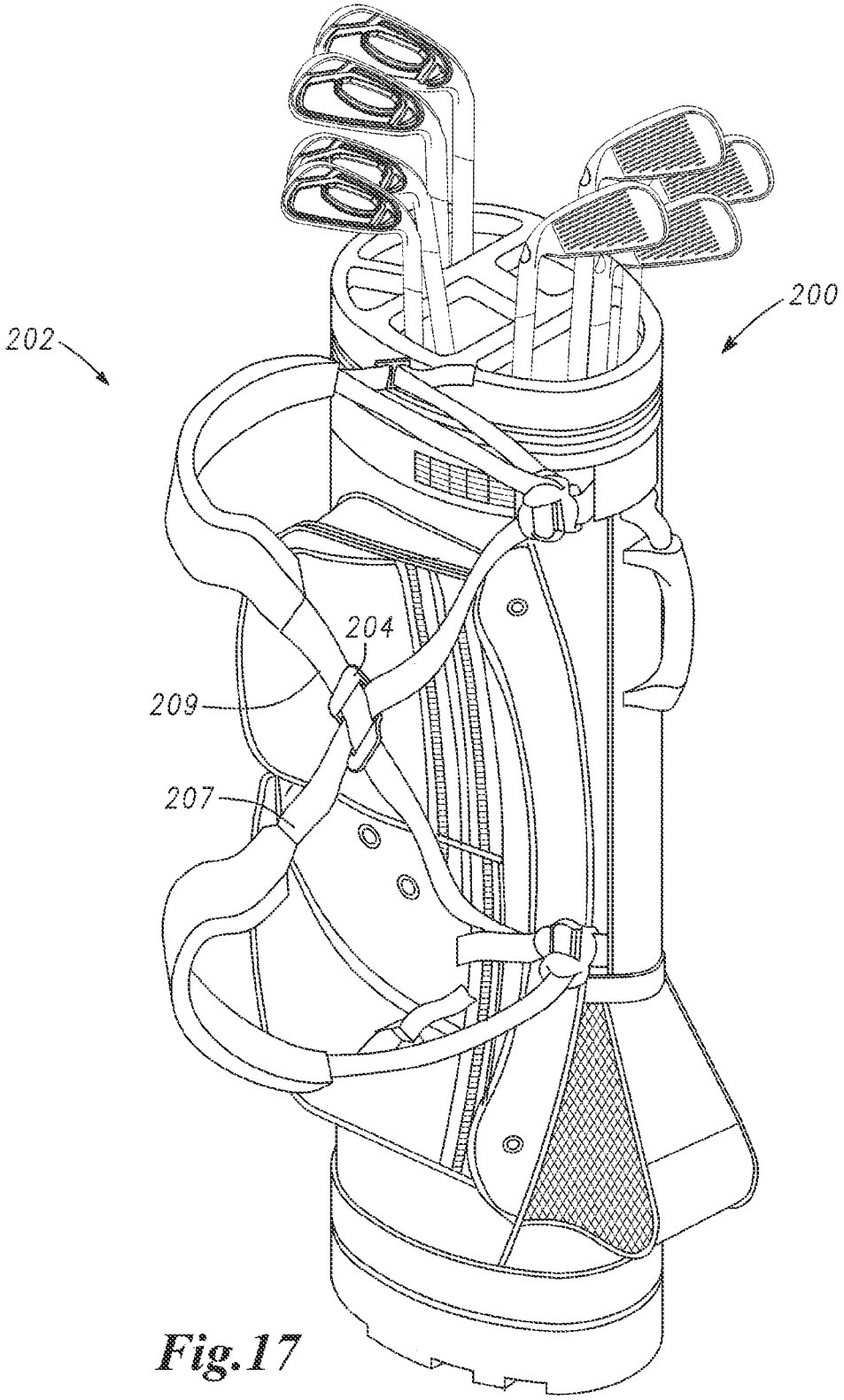
FIG. 17 is a perspective view of a golf bag coupled to the self-adjustable carrying strap system of FIG. 15.
Figure 18:
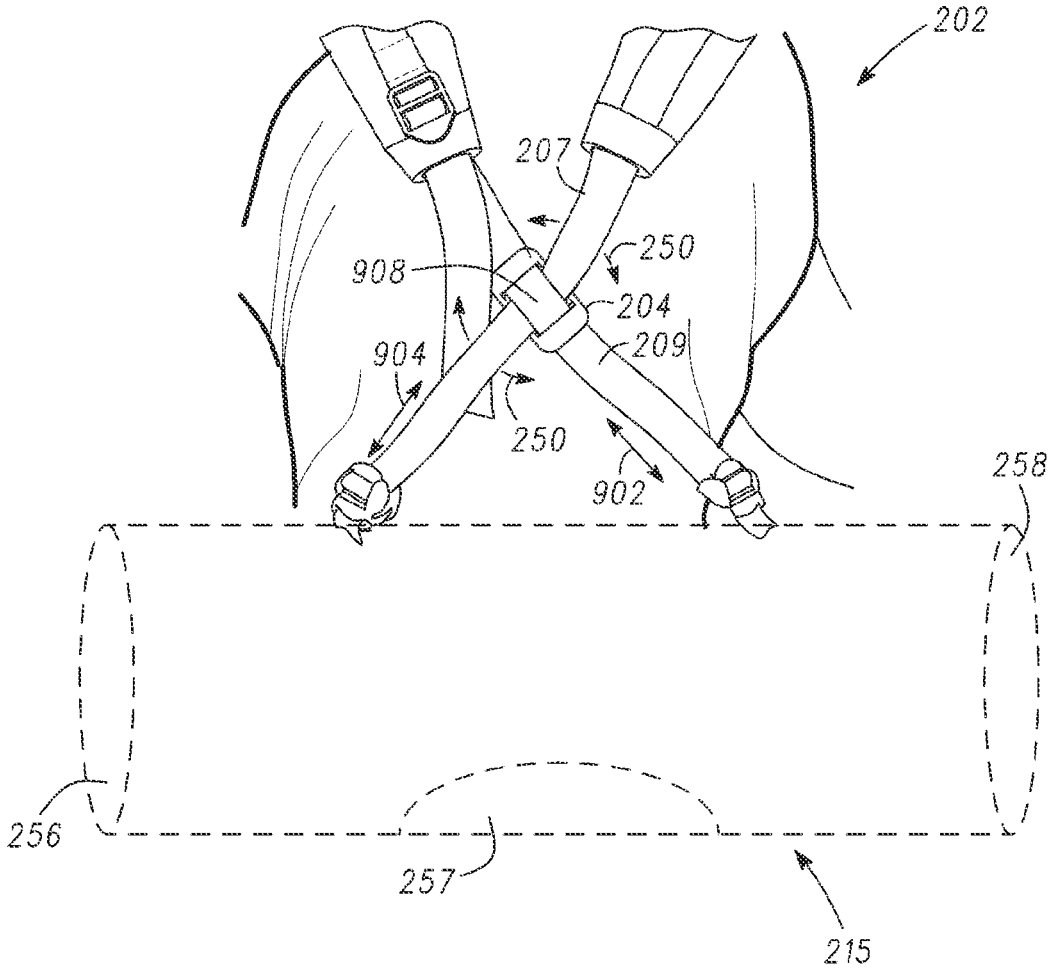
FIG. 18 is a perspective view of the bag with the self-adjustable carrying strap system engaged to an individual.
Figure 27:
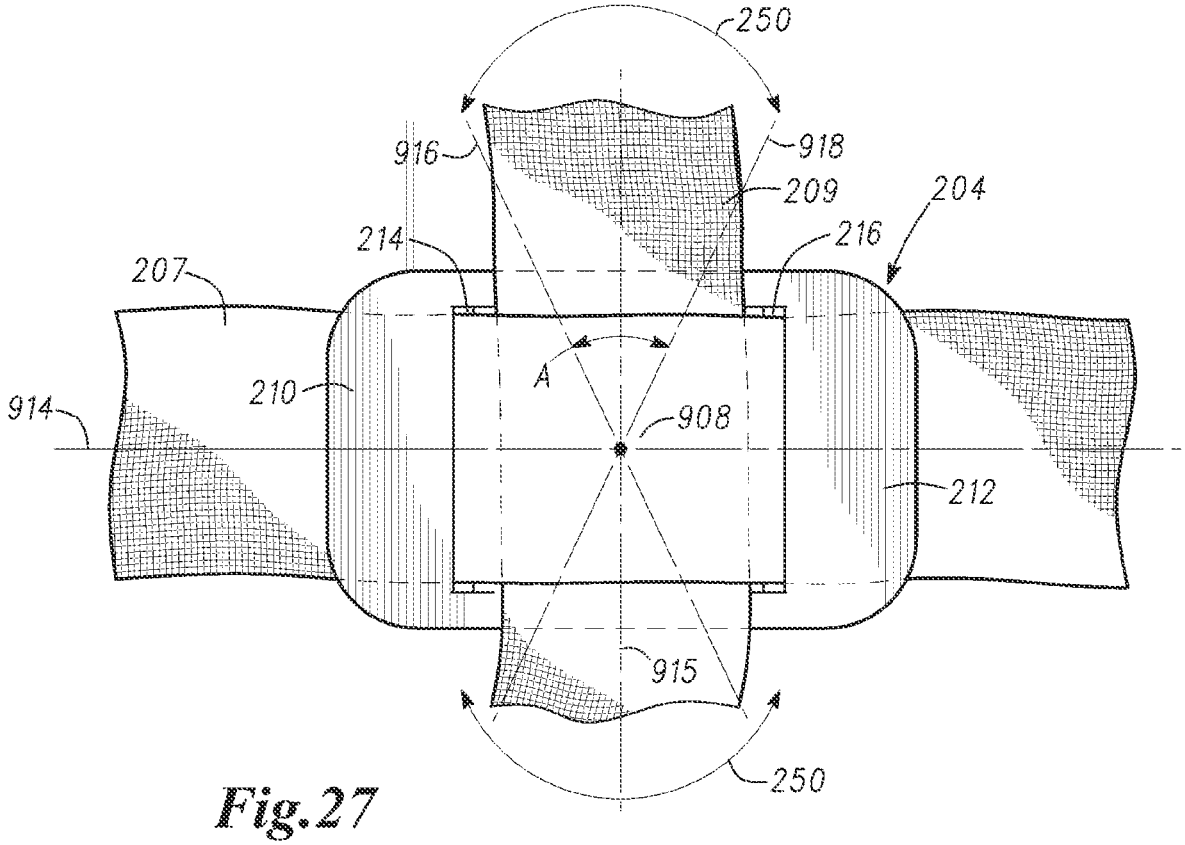
FIG. 27 is a front view of the second carrying strap inserted through the first and second channels and overlapping the first carrying strap along the connector plate while also showing the potential degree of swiveling movement of the second carrying strap.

Referring to FIGS. 15-25, a second embodiment of an adjustable carrying strap system, designated 202, includes a first carrying strap 207 defining a first proximal portion and a first distal portion and a second carrying strap 209 defining a second proximal portion and a second distal portion. The first and second carrying straps 207 and 209 overlap each other in a crossing fashion, such as an "X" formation, along a connector plate 204. In one embodiment, the first and second carrying straps 207 and 209 remain substantially in the "X" formation such that this overlapping arrangement allows the first and second carrying straps 207 and 209 to freely move relative to each other. This free movement of the first and second carrying straps 207 and 209 relative to each other permits the connector plate 204 to self-center and facilitate an even load-bearing being applied on each shoulder for both single and dual shoulder carrying arrangements by the first and second carrying straps 207 and 209. As shown in FIGS. 15, 16 and 18, the connector plate 204 is configured to allow the first and second carrying straps 207 and 209 to be self-adjustable relative to each other without any manual adjustment required by the individual such that the first and second carrying straps 207 and 209 freely move relative to each other along either axis 904 for the first carrying strap 207 or axis 906 for the second carrying strap 209 in response to the shifting of a bag 215 having an upper portion 256, middle portion 257 and lower portion 258. Referring to FIG. 27, the second carrying strap 209 is also capable of turning about a point 908 in a direction bounded by axes 916 and 918 when an adjustment to the second carrying strap 209 occurs as shall be explained in greater detail below.

Figure 19:
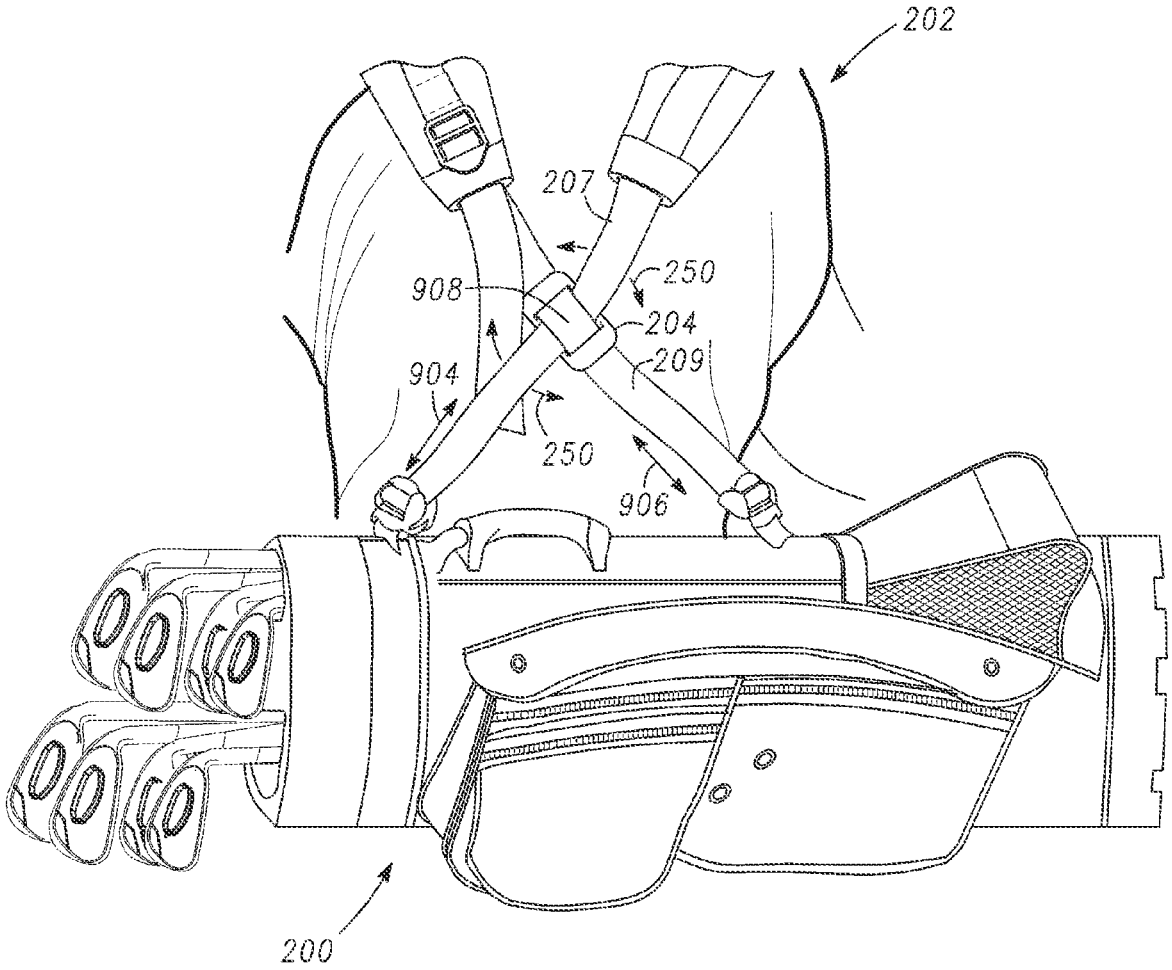
FIG. 19 is a perspective view of the golf bag with the self-adjustable carrying strap system engaged to an individual.
Figure 20:
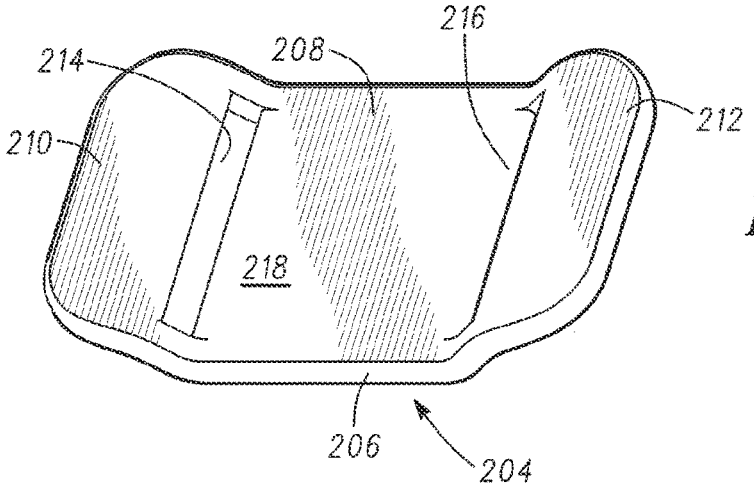
FIG. 20 is an elevated perspective view of another embodiment of a connector plate.

Referring to FIGS. 17 and 19, the self-adjustable carrying strap system 202 may also be engaged to a golf bag 200 in a manner similar to the bag 115. In particular, the first carrying strap 207 and the second carrying strap 209 overlap each other at the connector plate 204, which is configured to allow the first carrying strap 207 and the second carrying strap 209 to move along axis 904 and axis 906, respectively, when automatic adjustment of the self-adjustable carrying strap system 202 occurs. As noted above, the second carrying strap 209 is allowed to swivel about the point 908 when automatic adjustment of the second carrying strap 209 occurs.

Figure 21:
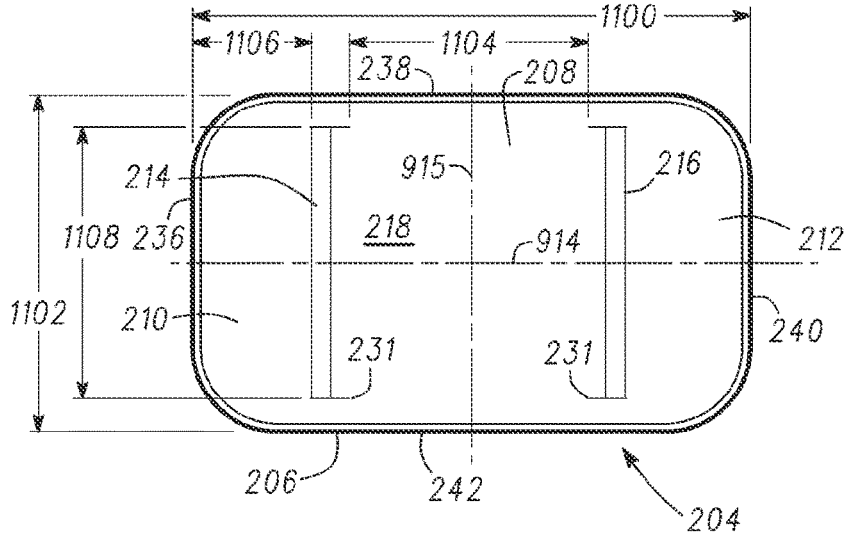
FIG. 21 is an front view of the connector plate.
Figure 22:
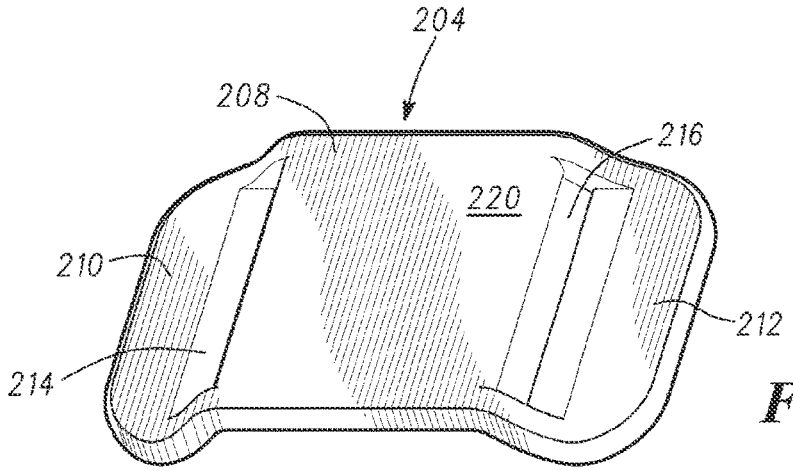
FIG. 22 is an elevated opposite perspective view of the connector plate of FIG. 20.
Figure 23:
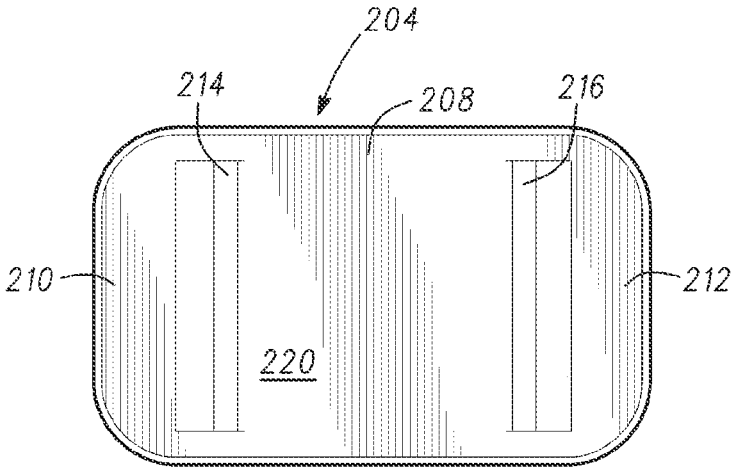
FIG. 23 is a rear view of the connector plate.
Figure 24:
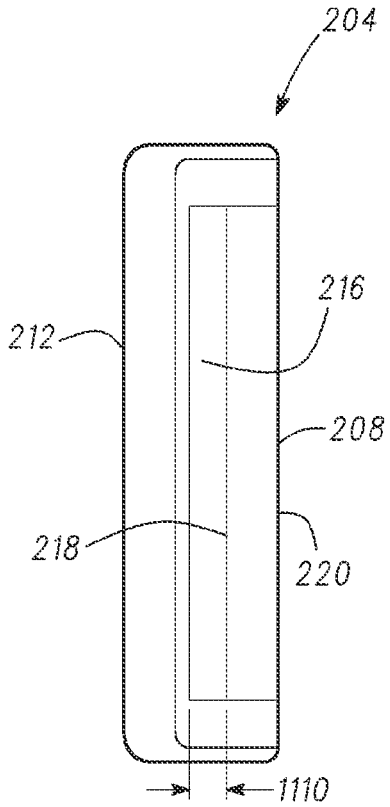
FIG. 24 is a side view of the connector plate.
Figure 25:
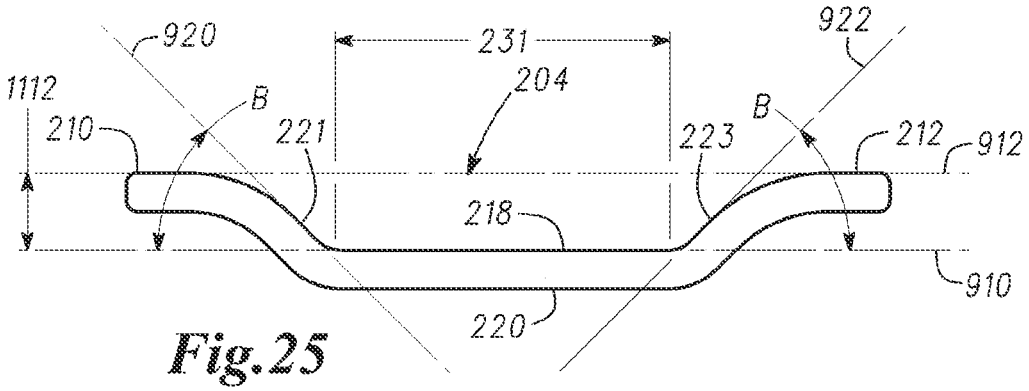
FIG. 25 is an end view of the connector plate.

Referring to FIGS. 20-25, the connector plate 204 is a modular component that may be added after-market to an existing bag 215. The connector plate 204 is configured to permit the first and second carrying straps 207 and 209 to overlap each other along the connector plate 204 and move relative to each other without manual intervention when the bag 215 shifts as it is being carried or as the bag 215 changes position relative to an individual carrying the bag 215. As shown in FIGS. 21 and 25, the connector plate 204 includes a connector plate body 206 having a middle portion 208 in communication with opposing first and second raised portions 210 and 212 in parallel orientation that define a transverse space 231 in the area of the connector body 206 between the first and second raised portions 210 and 212. The connector plate 204 further defines a first transition portion 221 defined between the middle portion 208 and the first raised portion 210 and a second transition portion 223 defined between the middle portion 208 and the second raised portion 212. The first transition portion 221 is substantially aligned along a plane 920 at an angle B, while the second transition portion 223 is substantially aligned along a plane 922 at the same angle B. In some embodiments, the angle B defined between respective planes 920 or 922 with the plane 910 may be an obtuse angle, an acute angle, or a perpendicular angle. In one embodiment, angle B may range between 30 degrees and 130 degrees. The connector plate body 206 defines a front surface 218 and a rear surface 220 having a first side 236, second side 238, third side 240 and fourth side 242 that collectively form a generally rectangular shape. In some embodiments, the first, second, third and fourth sides 236, 238, 240 and 242 may form curved or sharp edges. In some embodiments, the first, second, third and fourth sides 236, 238, 240 and 242 may have a symmetrical configuration, an asymmetrical configuration, an asymmetrical or tapered configuration, although the apparatus, articles of manufacture, and methods described herein are not limited in this regard. For example, the connector plate body 206 may have a square configuration, a circular configuration, an oval configuration, and a rectangular configuration.

Referring to FIG. 25, the first and second slots 214 and 216 are defined above a first plane 910 configured to receive the first or second carrying straps 207 or 209 when inserted through the first and second slots 214 and 216. As used herein, the term "slot" refers to any elongated opening having dimensions sufficient to receive the first carrying strap 207. As shown in FIG. 21, the first and second slots 214 and 216 are aligned to define a first pathway along a longitudinal axis 914, while the transverse space 231 is aligned along a second pathway along a latitudinal axis 915. The first pathway along axis 914 and the second axis along latitudinal axis 915 may be in transverse orientation to each other in a cross configuration. In addition, the first pathway along longitudinal axis 914 may be configured to receive the first carrying strap 207, while the second pathway along latitudinal axis 915 may be configured to receive the second carrying strap 209 so that the first carrying strap 207 crosses over and overlaps the second carrying strap 209 when engaged to the connector plate 204. In other embodiments, the first pathway along longitudinal axis 914 may receive the second carrying strap 209, while the second pathway along the latitudinal axis 915 may receive the first carrying strap 207.

Referring back to FIG. 25, plane 910 is defined adjacent or proximate to the front surface 218 of the connector plate body 206 and extends in parallel fashion to the first pathway along longitudinal axis 914 and the second pathway along latitudinal axis 915. When the first carrying strap 207 crosses over the second carrying strap 209 along the connector plate 204, both the first and second carrying straps 207 and 209 are disposed adjacent or proximate to plane 910. Referring to FIGS. 18, 19 and 27, the second carrying strap 209 is capable of a turning motion 250 relative to the first carrying strap 207 such that the second carrying strap 209 may self-adjust and move in a direction between axes 916 and 918 at an angle A (FIG. 27) which may range between +15±20 degrees and −15±20 degrees from normal. In one embodiment, the turning motion of the second carrying strap 209 is created by length of the second pathway being longer than the width of the second carrying strap 209 which allows the second carrying strap 209 to move and turn laterally. As used herein, the term "turning" refers to any type of lateral, transverse, swiveling or rotating motion by the second carrying strap 209 either about a point 908 or relative to the first carrying strap 207 in any direction defined between axes 916 and 918.

As shown in FIGS. 21, 24 and 25, the connector plate 204 may have a length 1100 of approximately 62 mm corresponding to the overall length of the connector plate body 206, a length 1102 of approximately 38 mm corresponding to the length of the first and third sides 236 and 240, a length 1106 of approximately 14 mm corresponding to length of the first and second raised portions 210 and 212, a length 1108 of approximately 30 mm corresponding to the length of the first and second slots 214 and 216, a length 1104 of approximately 30 mm corresponding to the length between the first and second slots 214 and 216, a length 1110 of approximately 3 mm corresponding to the height of the first and second slots 214 and 216, and a length 1112 of approximately 6 mm corresponding to the height of the first and second raised portions 210 and 212. In one embodiment, the length 1104 corresponding to the length between the first and second slots 214 and 216 that define the width of the second pathway is longer than the length 1108 corresponding to the length of the first and second slots 214 and 216 such that the width of the second carrying strap 209 is always shorter than the width of the second pathway, thereby allowing the second carrying strap 209 sufficient room to move laterally. In some embodiments, the range of dimensions for the connector plate body 206 may include a length 1100 between 50 mm to 70 mm, a length 1102 between 36 mm to 42 mm, a length 1104 between 28 mm to 32 mm, a length 1106 between 11 mm to 17 mm, a length 1108 between 29 mm to 32 mm, a length 1110 between 3 mm to 4 mm, and a length 1112 between 5 mm to 7 mm.

Figure 26:
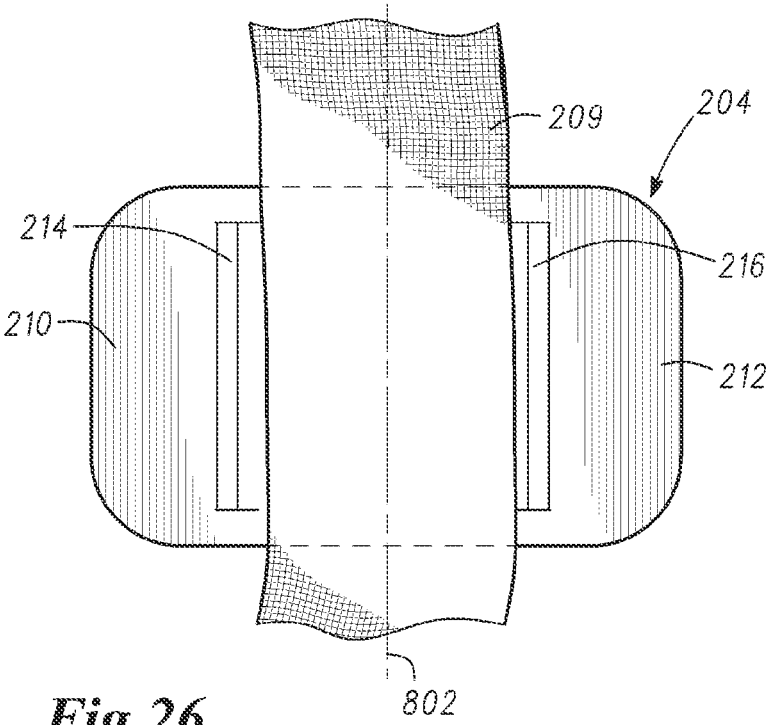
FIG. 26 is a front view of the first carrying strap received between the first and second channels of the connector plate.
Figure 28:
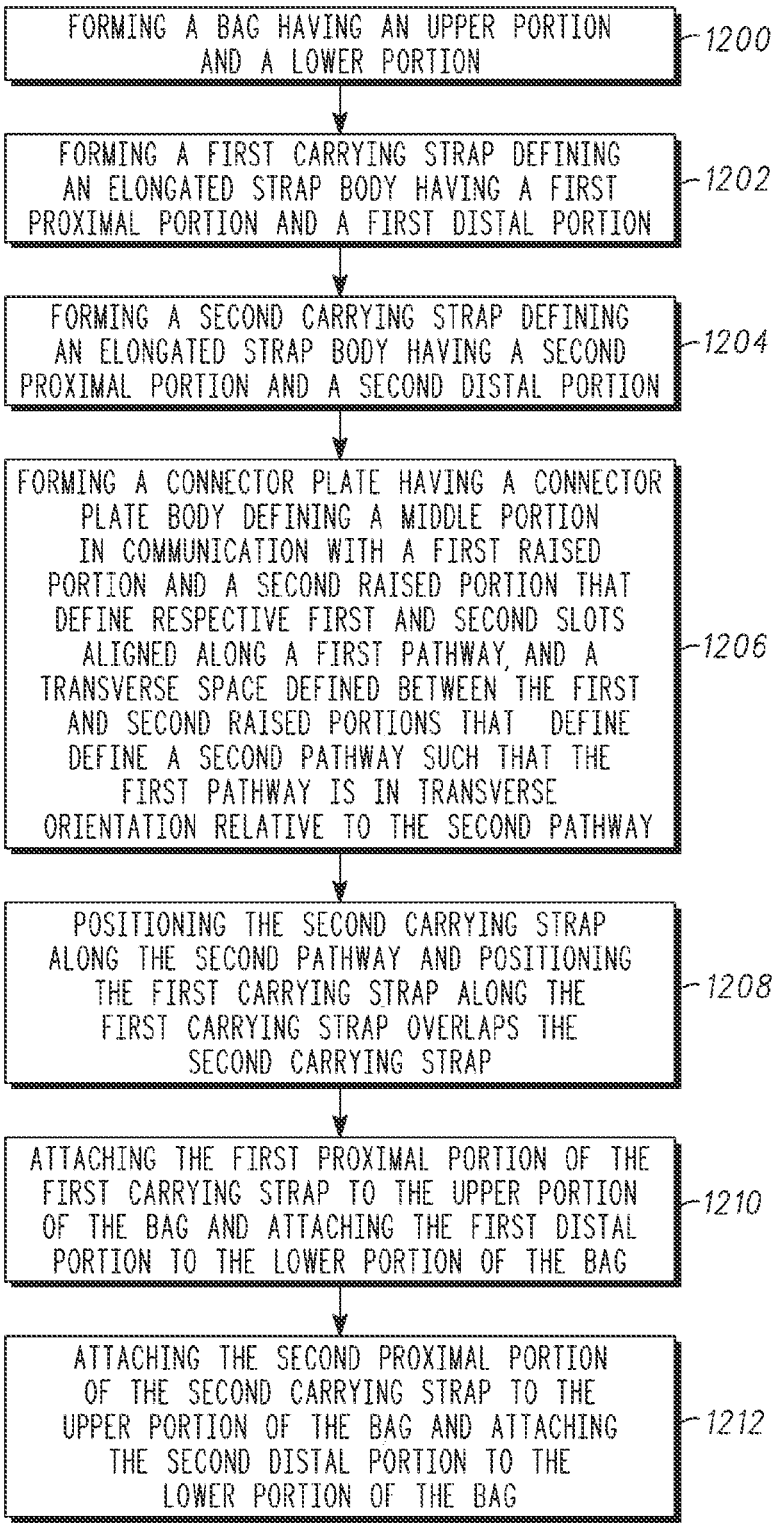
FIG. 28 is a flow chart illustrating a method for manufacturing a golf bag having the self-adjustable carrying strap system of FIG. 15.

A method of manufacturing the bag 215 with the self-adjustable carrying strap system 202 is also illustrated in FIGS. 26-28. Referring to FIG. 28, at block 1200 forming the bag 215 having an upper portion 256 and lower portion 258. At block 1202 forming a first carrying strap 207 having a first proximal portion 284 and a first distal portion 286 At block 1204, forming a second carrying strap 209 having a second proximal portion 280 and a second distal portion 282. At block 1206, forming a connector plate 204 having a connector plate body 206 defining a middle portion 208 in communication with a first raised portion 210 that defines a first channel 214 and a second raised portion 212 that defines a second channel 216 with the first and second raised channels 210 and 212 being aligned along a first pathway and a transverse space defined between the first and second raised portions 210 and 212 that define a second pathway such that the first pathway is in transverse orientation relative to the second pathway. At block 1208, positioning the second carrying strap 209 along the second pathway and positioning the first carrying strap 207 along the first pathway such that the first carrying strap 207 overlaps the second carrying strap 209. In this intersecting arrangement, the first carrying strap 207 and the second carrying strap 209 overlap each other in a transverse orientation. At block 1210, attaching the first proximal portion 284 of the first carrying strap 207 to the upper portion 256 of the bag 215 and attaching the first distal portion 286 to the lower portion 258 of the bag 215. At block 1212, attaching the second proximal portion 280 of the second carrying strap 209 to the upper portion 256 of the bag and attaching the second distal portion 282 to the lower portion 258 of the bag 215. In addition, the first and second carrying straps 207 and 209 may move freely relative to each other such that each respective first and second carrying strap 207 and 209 automatically adjusts without manual intervention by the individual whenever the bag 215 shifts as the individual is carrying the bag 215. In one embodiment, the connector plate body 206 may be formed using a molding process, a stamping process, a milling process, and a combination thereof. In some embodiments, the connector plate body 206 maybe made from a plastic, metal, or a composite material. In addition, the first and second raised portions 210 and 212 may be attached or otherwise affixed to the middle portion 208 during manufacture or the connector body plate 206 may be formed such that the middle portion 208 and the first and second raised portions 210 and 212 are formed as a single unitary body; however, the apparatus, articles of manufacture, and methods described herein are not limited in this regard. The method of manufacture described above may be used to manufacture the golf bag 200 with the self-adjustable carrying strap system 202 as illustrated in FIGS. 26-28.

Similar to bag 115, bag 215 may be able to carry or transport weighted objects. The weighted objects may be any item that can fit in the bag 215 including, but not limited to, golf clubs including iron-type golf clubs, wood-type golf clubs, and putter-type golf clubs, as well as other objects as described above for golf bag 115. In addition, the bag 215 may be in any configuration or shape as long as it is connected to the self adjustment carrying strap system 202. In some embodiments, the bag 215 may be generally a golf bag, a rucksack, a duffel bag, or a suitcase.

The golf bags 100 and 200 may be made from a variety of materials, such as leather, synthetic rubber, neoprene, polyethylene, polyurethane, acrylonitrile butadiene styrene, plastic, fabric material, or combinations thereof. In addition, the first and second carrying straps 110,112,207, and 209 may also be made from a variety of materials, such as leather, synthetic rubber, neoprene, polyethylene, polyurethane, acrylonitrile butadiene styrene, plastic, fabric material, or combinations thereof. The apparatus, articles of manufacture, and methods described herein are not limited in this regard.

Figure 31:
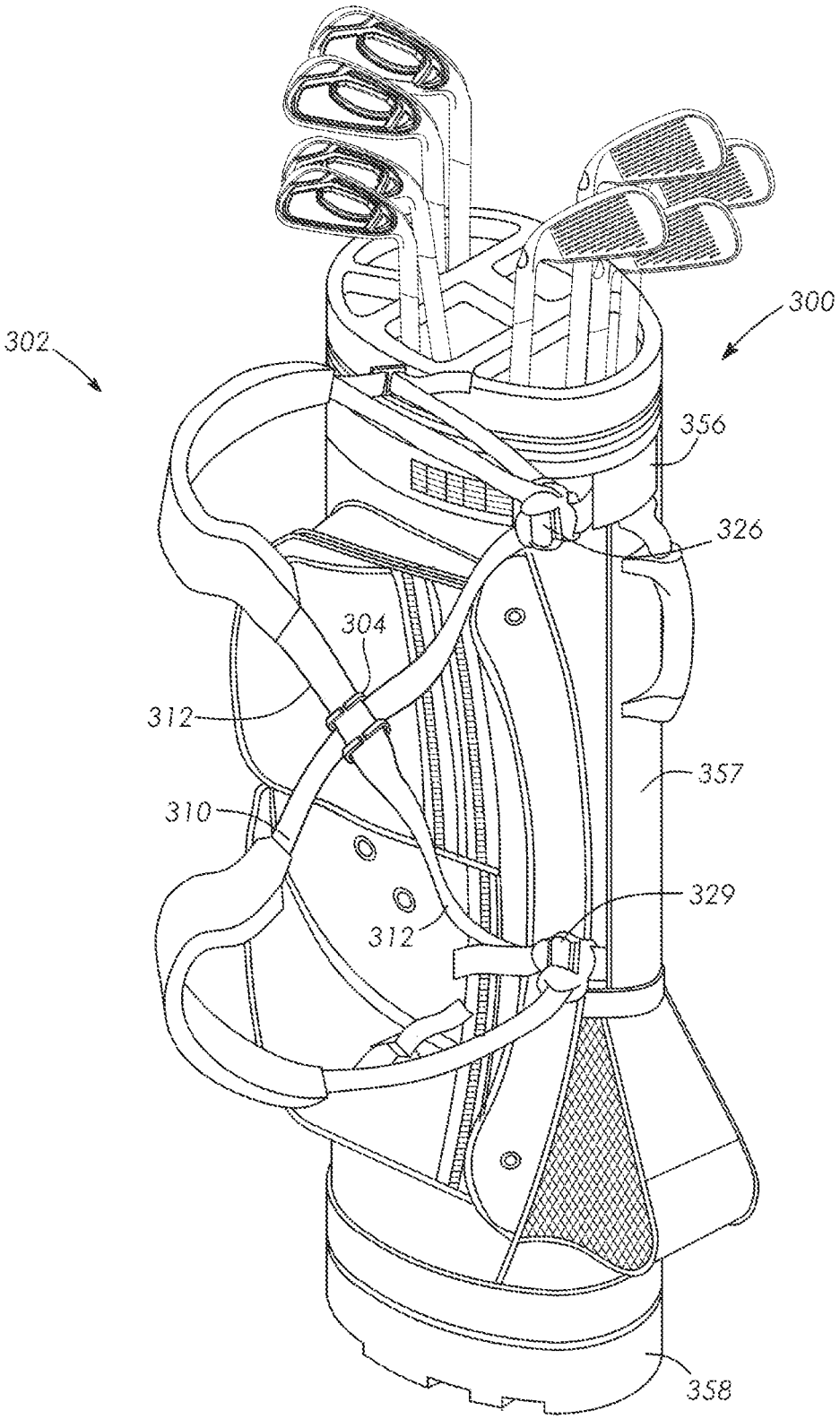
FIG. 31 is a perspective view of a golf bag coupled to the self-adjustable carrying strap system of FIG. 29.
Figure 32:
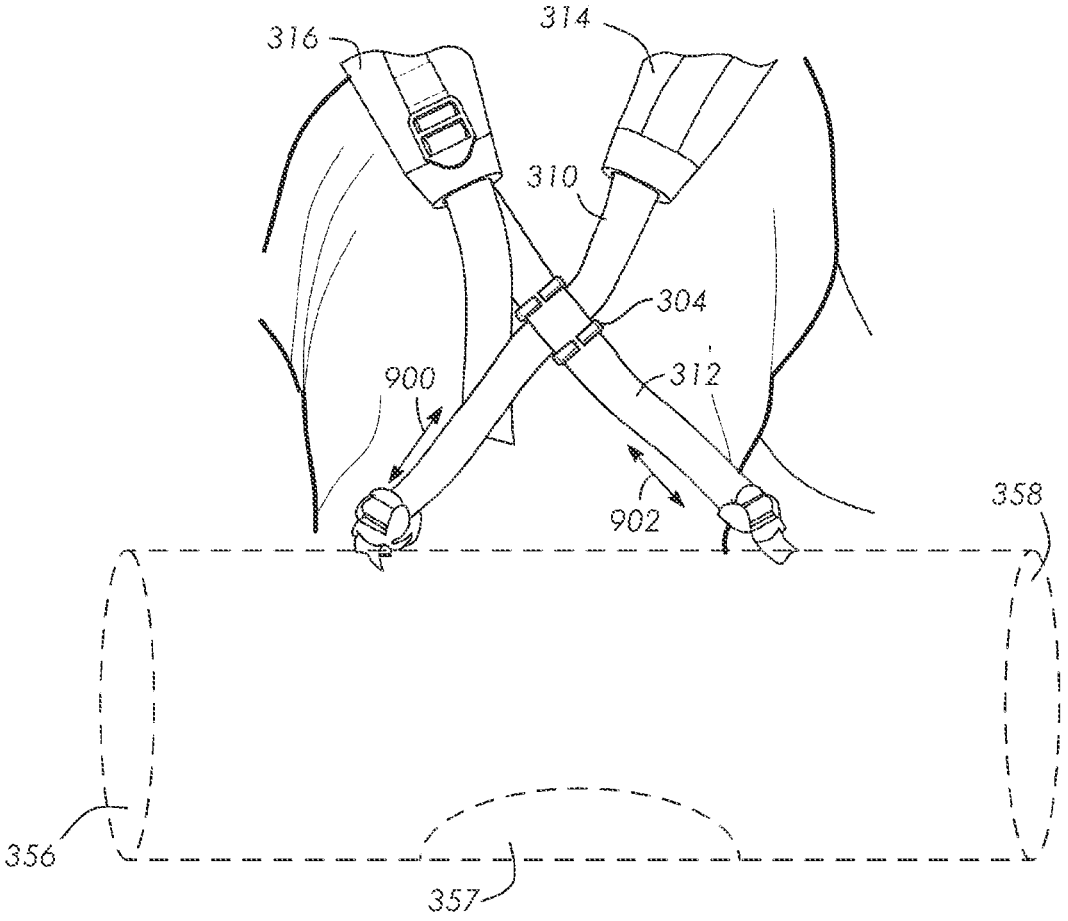
FIG. 32 is a perspective view of the bag with the self-adjustable carrying strap system of FIG. 29 engaged to an individual.

Referring to the FIGS. 29-43, a third embodiment of the self-adjustable carrying strap system, designated 302, is illustrated. In this embodiment, the self-adjustable carrying strap system 302 is connected to a bag 315 that may contain weighted objects. The self-adjustable carrying strap system 302 includes a first carrying strap 310 and a second carrying strap 312 that overlap each other in a crossing fashion along a connector plate 304. In this embodiment, the connector plate 304 is configured to allow the first and second carrying straps 310 and 312 to be self-adjustable relative to each other without any manual adjustment required by the individual such that the first and second carrying straps 310 and 312 freely move relative to each other along either axis 900 for the first carrying strap 310 or axis 902 for the second carrying strap 312 in response to the shifting of the bag 315 as shown in FIG. 32.

Figure 29:
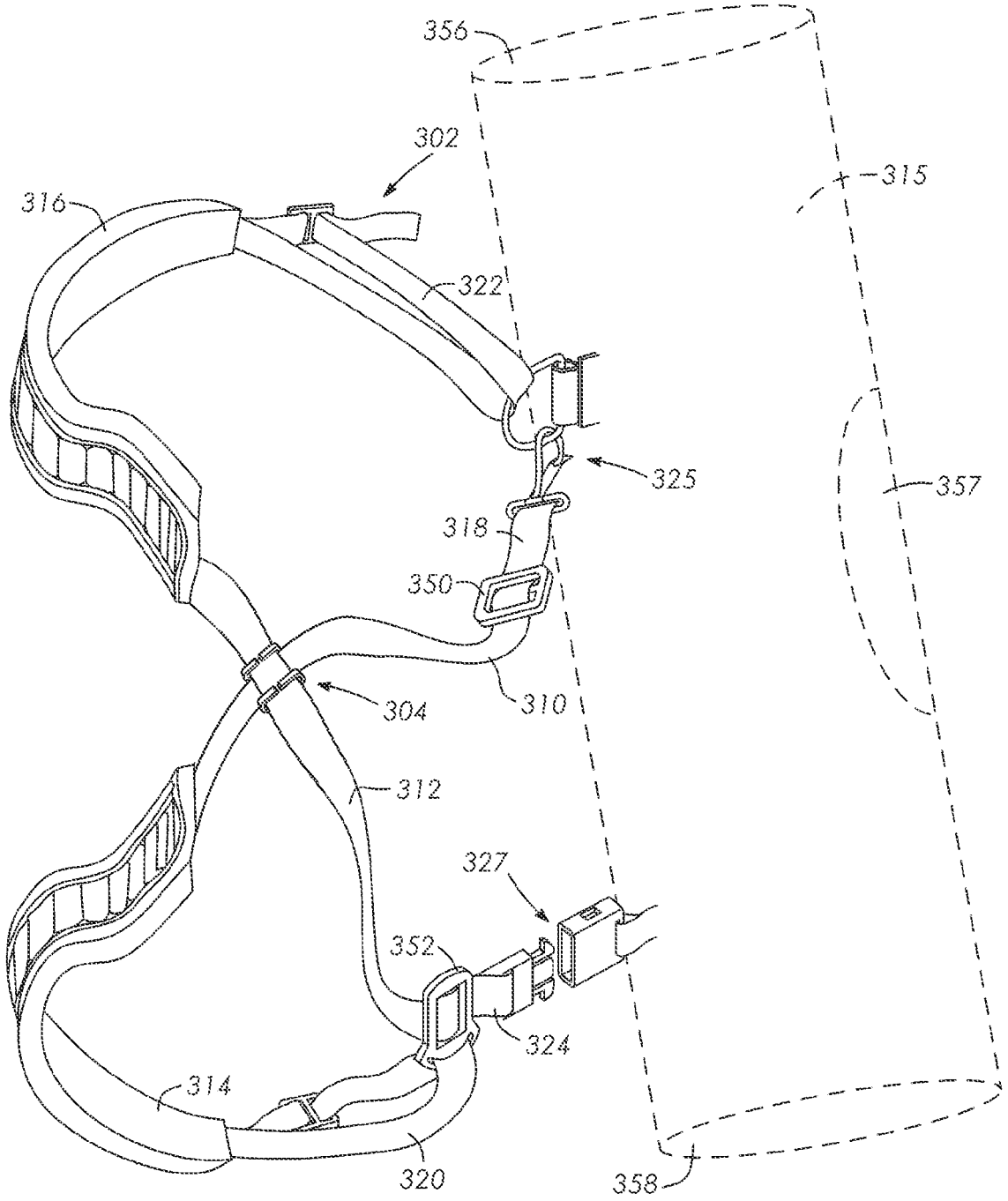
FIG. 29 is a perspective view of a bag coupled to a third embodiment of the self-adjustable carrying strap system.
Figure 30:
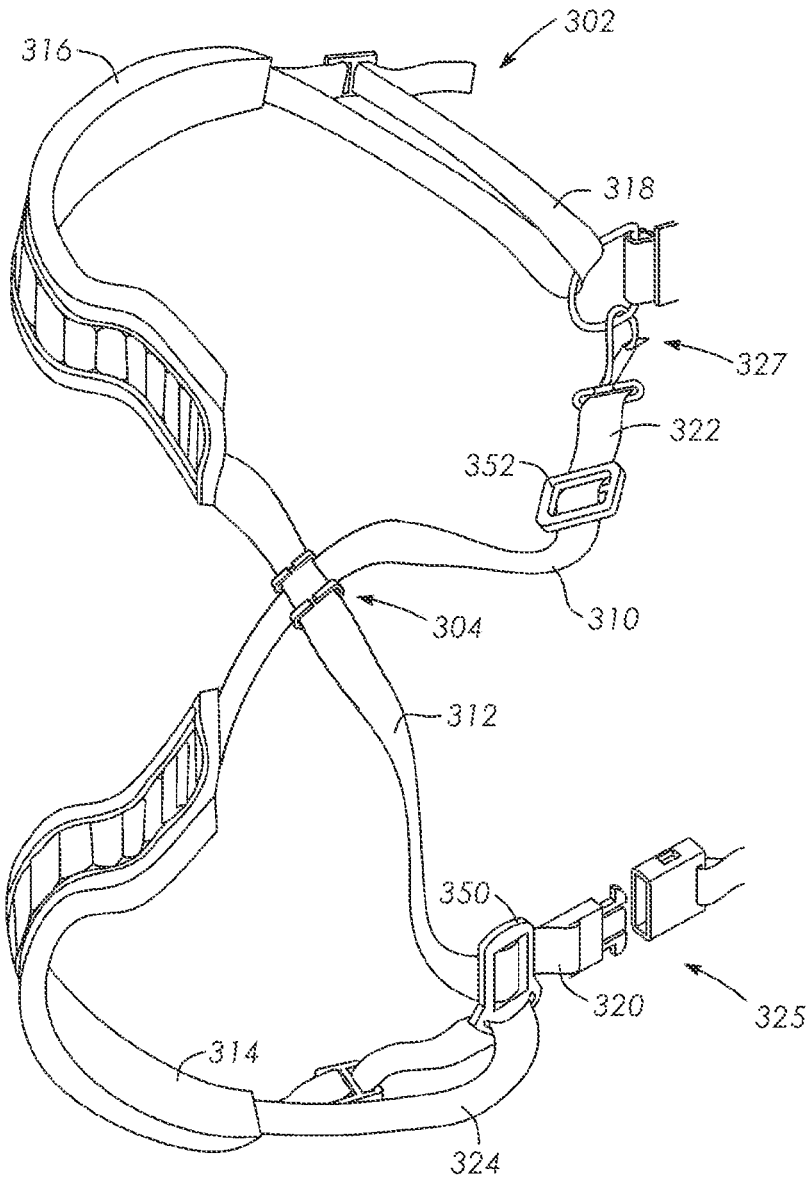
FIG. 30 is a perspective view of the self-adjustable carrying strap system of FIG. 29 having a first carrying strap, a second carrying strap and a connector plate.

In some embodiments as shown in FIGS. 29 and 30, the first carrying strap 310 may include a first shoulder pad 314 and the second carrying strap 312 may include a second shoulder pad 316 to provide a cushioning effect as the individual carries the bag 315. In some embodiments, the first carrying strap 310 may include a first buckle 350 that allows the individual to adjust the length of the first carrying strap 310, while the second carrying strap 312 may include a second buckle 352 that also allows the individual to adjust the length of the second carrying strap 312. As shown in FIG. 31, in some embodiments a first connector 326 may couple the respective ends of the first and second carrying straps 310 and 312 to the first end 356 of the golf bag 300, while a second connector 329 may couple the respective opposite ends of the first and second carrying straps 310 and 312 to the third portion 358 of the golf bag 300.

Referring to FIGS. 29 and 30, in some embodiments proximal portions 318 and 322 of the first and second carrying straps 310 and 312, respectively, may be engaged together at a first connector arrangement 325 to connect the first and second carrying straps 310 and 312 adjacent or proximate to the first end 356 of the bag 315. Similarly, the distal portions 320 and 324 of the first and second carrying straps 310 and 312, respectively, may be engaged together at a second connector arrangement 327 to connect the first and second carrying straps 310 and 312 adjacent or proximate to a third portion 358 of the bag 315. The distal portions 320 and 324 of the first and second carrying straps 310 and 312 may be engaged together at a second connector arrangement 325 to connect the first and second carrying straps 310 and 312 opposite to the second end 357 of the bag 315. However, in other embodiments the proximal portions 318 and 322 and distal portions 320 and 324 of the first and second carrying straps 310 and 312 may be separately connected to the bag 315 using additional connector arrangements 325 and 327 as shown in FIG. 31. In one aspect, the first and second connector arrangements 325 and 327 may be a ring and loop arrangement, an independent buckle, a hook fastener arrangement, and a snap-fit connector arrangement.

Figure 42:
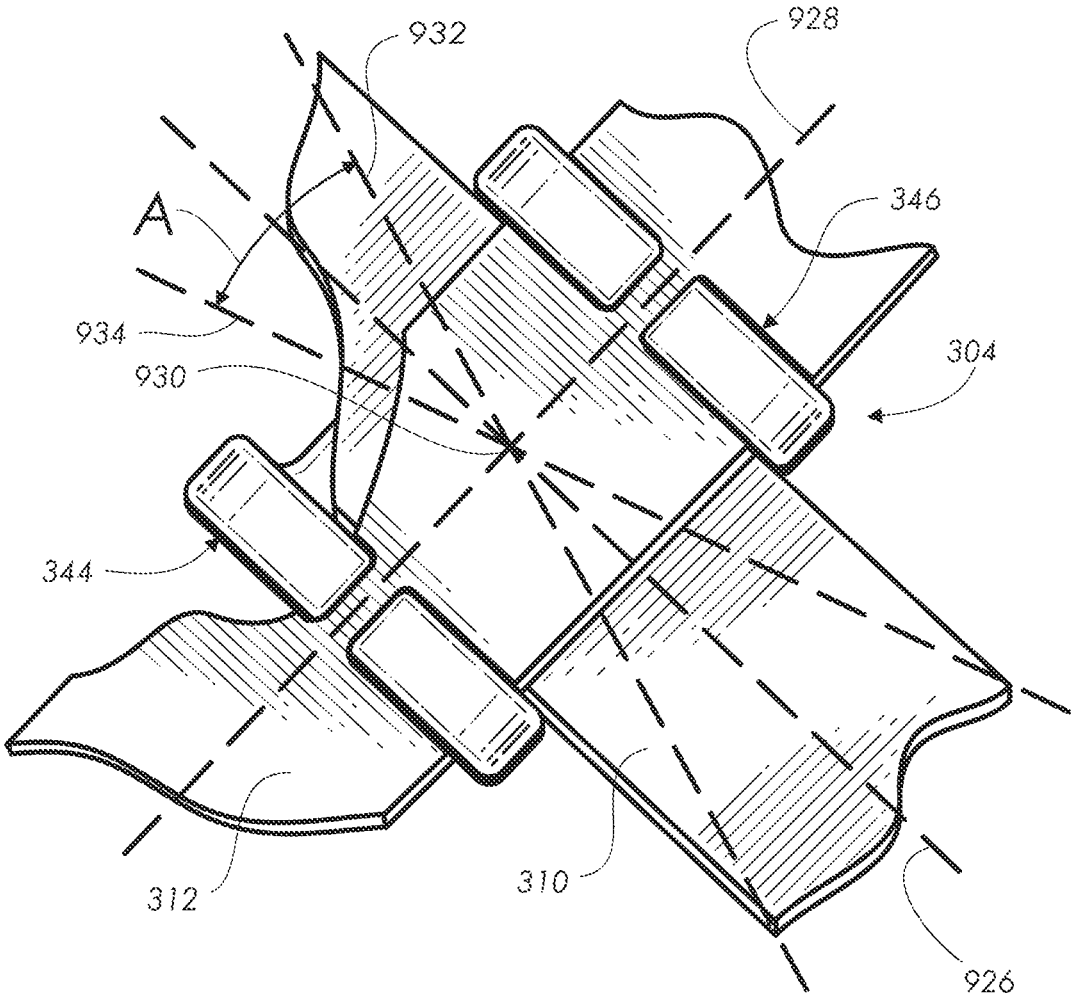
FIG. 42 is a front view of the second carrying strap inserted through the first and second channels and overlapping the first carrying strap along the connector plate of FIG. 29, while also showing the potential degree of swiveling movement of the second carrying strap.

In one embodiment as shown in FIG. 42, the first and second carrying straps 310 and 312 remain substantially in the "X" formation such that this overlapping arrangement allows the first and second carrying straps 310 and 312 to freely move relative to each other. This free movement of the first and second carrying straps 310 and 312 relative to each other permits the connector plate 304 to self-center and facilitate an even load-bearing being applied on each shoulder for both single and dual shoulder carrying arrangements by the first and second carrying straps 310 and 312. As shown in FIGS. 29, 30 and 32, the connector plate 304 is configured to allow the first and second carrying straps 310 and 312 to be self-adjustable relative to each other without any manual adjustment required by the individual such that the first and second carrying straps 310 and 312 freely move relative to each other along either axis 900 (FIG. 33) for the first carrying strap 310 or axis 902 (FIG. 33) for the second carrying strap 310 in response to the shifting of a bag 315 having an upper portion 356, middle portion 357 and lower portion 358. Referring back to FIG. 42, the second carrying strap 312 is also capable of turning or swiveling about a point 930 in a direction bounded by axes 932 and 934 when an adjustment to the second carrying strap 312 occurs as shall be explained in greater detail below.

As further shown in FIG. 42, the second carrying strap 312 is capable of a turning motion relative to the first carrying strap 310 such that the second carrying strap 312 may self-adjust and move in a direction between axes 932 and 934 at an angle A, which may range between +15±20 degrees and −15±20 degrees from normal. In one embodiment, the turning motion of the second carrying strap 312 is created by length of the second pathway being longer than the width of the second carrying strap 312 which allows the second carrying strap 312 to move and turn laterally. As used herein, the term "turning" refers to any type of lateral, transverse, swiveling or rotating motion by the second carrying strap 312 either about a point 930 or relative to the first carrying strap 310 in any direction defined between axes 932 and 934.

Referring to FIGS. 34-42, the connector plate 304 is a modular component that may be added after-market to an existing bag 315. The connector plate 304 is configured to permit the first and second carrying straps 310 and 312 to overlap each other along the connector plate 304 and move relative to each other without manual intervention when the bag 315 (FIG. 32) shifts as it is being carried or as the bag 315 changes position relative to an individual carrying the bag 315. The connector plate 304 includes a connector body 305 defined by a front surface 328 and a rear surface 330 having a first side 336, second side 338, third side 340 and fourth side 342 that collectively form a generally rectangular shape. In some embodiments, the first side 336, second side 338, third side 340 and fourth side 342 may have a substantially straight configuration, although in other embodiments the first side 336, second side 338, third side 340 and fourth side 342 may have generally curved or tapered configuration. In some embodiments, first, second third and fourth sides 336, 338, 340 and 342 may have a symmetrical configuration, an asymmetrical or tapered configuration, or a combination symmetrical and asymmetrical or tapered configuration, although the apparatus, articles of manufacture, and methods described herein are not limited in this regard. For example, the connector plate body 305 may have a square configuration, a circular configuration, an oval configuration, and a rectangular configuration. As further shown, the connector plate 304 includes a first bridge portion 332 and a second bridge portion 334 in parallel orientation that define a transverse space 331 in the area of the connector plate body 305 between the first and second bridge portions 332 and 334. The first and second bridge portions 332 and 334 may be engaged or integral with the connector plate body 305.

Figure 37:
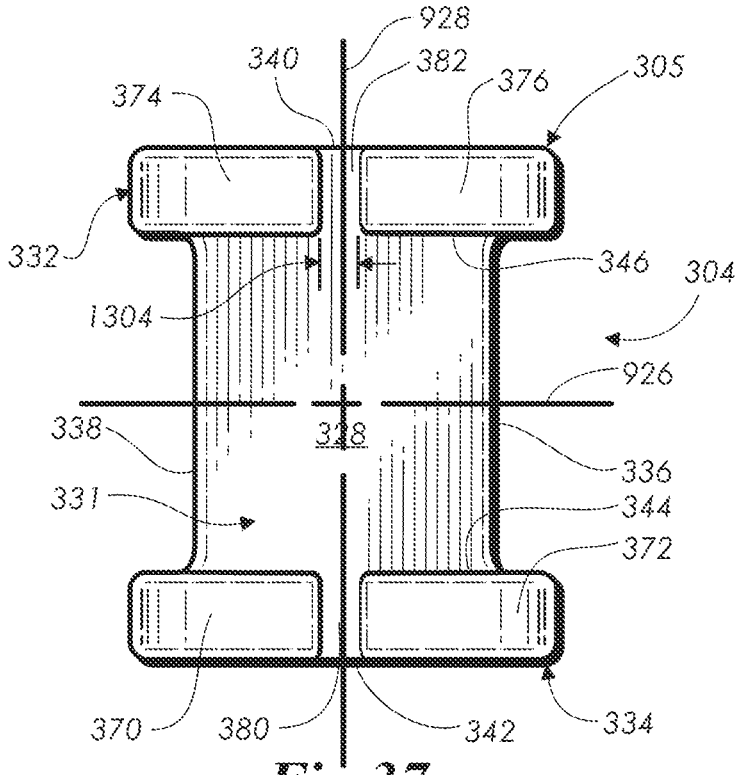
FIG. 37 is a front view of the connector plate.

As further shown in FIGS. 35, 37, 40 and 41, the first bridge portion 332 includes a first arm 374 and an opposing second arm 376 that collectively define a first channel 344 configured to receive either the first strap 310 or second strap 312 therethrough, while the second bridge portion 334 includes a first arm 370 and an opposing second arm 372 that collectively define an identical second channel 346 configured to receive either the first strap 332 or second strap 334 therethrough. In addition, as shown in FIG. 37, a space 382 is defined between the first arm 374 and second arm 376 of the first bridge portion 332, while a space 380 is defined between the first and second arms 370 and 372. In some embodiments, the spaces 380 and 382 are configured to allow the first strap 310 to be disengaged from the connector plate 304 through the spaces 380 and 382 rather than through the first and second channels 344 and 346. For example, the first strap 310 or the second strap 312 may be folded, such as along longitudinal axis 928 such that the folded first or second straps 310, 312 may pass through the spaces 380 and 382. In another example, one of the edges of the first strap 310 or second strap 312 may be grasped by an individual and oriented to pass through the spaces 380 and 382 in order to disengage the first strap 310 or second strap 312 from the connector plate 304.

In some embodiments, the first and second arms 370, 374 and 372, 376 may collectively form respective arch-shaped channels 344 and 346; however, in other embodiments, the first and second arms 370, 374 and 372, 376 may collectively form substantially rectangular-shaped, square-shaped, asymmetrically-shaped, and/or symmetrically-shaped channels 344 and 346.

In some embodiments, the connector plate 304 may be made from a flexible plastic material that allow the first and second arms 370,374 and 372,376 to flex substantially downward or upward direction such that the respective linear distance 1304 (FIG. 37) of respective spaces 380 and 382 become enlarged when an external force is applied to the first and second bridge portions 332 and 334. In other embodiments, the connector plate 304 may be made from a metal or hard plastic material that does not allow the first and second arms 370, 374 and 372, 376 to flex such that the respective linear distances 1304 of spaces 380 and 382 remain the same.

Figure 40:
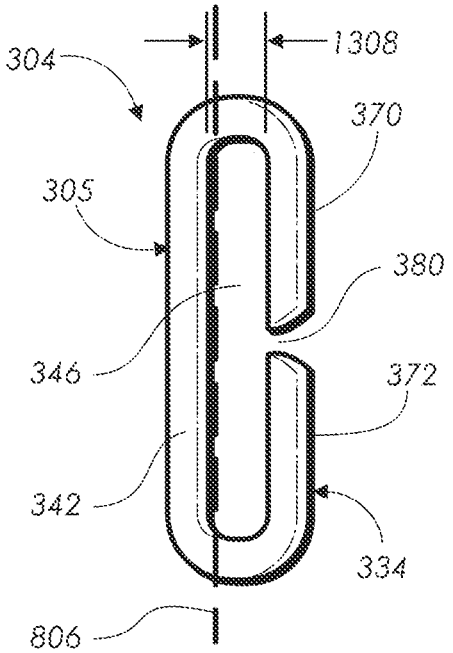
FIG. 40 is an end view of the connector plate.
Figure 41:
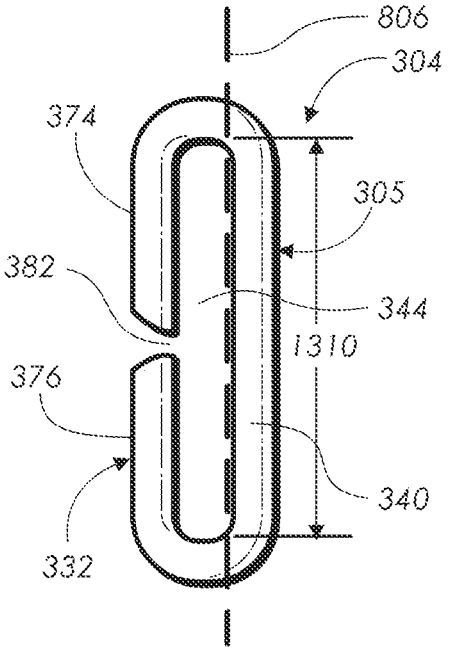
FIG. 41 is an opposing end view of the connector plate.

As shown in FIGS. 40 and 41, the first and second bridge portions 332 and 334 define the respective first and second channels 344 and 346, respectively, above a plane 806 configured to receive the first or second carrying straps 310 or 312 when inserted through the first and second channels 344 and 346 as shown in FIG. 42. As shown in FIGS. 37 and 42, the first and second channels 344 and 346 are aligned to define a first pathway along a longitudinal axis 928, while a transverse space 331 (FIG. 37) is aligned to define a second pathway along a latitudinal axis 926. The first pathway along longitudinal axis 928 and the second pathway along latitudinal axis 926 may be in transverse orientation to each other in a crossing configuration. In addition, the first pathway along longitudinal axis 928 may be configured to receive the first carrying strap 310, while the second pathway along latitudinal axis 926 may be configured to receive the second carrying strap 312 so that the first carrying strap 310 crosses over and overlaps the second carrying strap 312 when engaged to the connector plate 304. In other embodiments, the first pathway along longitudinal axis 928 may receive the second carrying strap 312, while the second pathway along latitudinal axis 926 may receive the first carrying strap 310.

Referring to FIG. 42, when the first carrying strap 310 crosses over the second carrying strap 312 along the connector plate 304, both the first and second carrying straps 310 and 312 are disposed adjacent or proximate to plane 806 (FIGS. 40 and 41).

Figure 38:
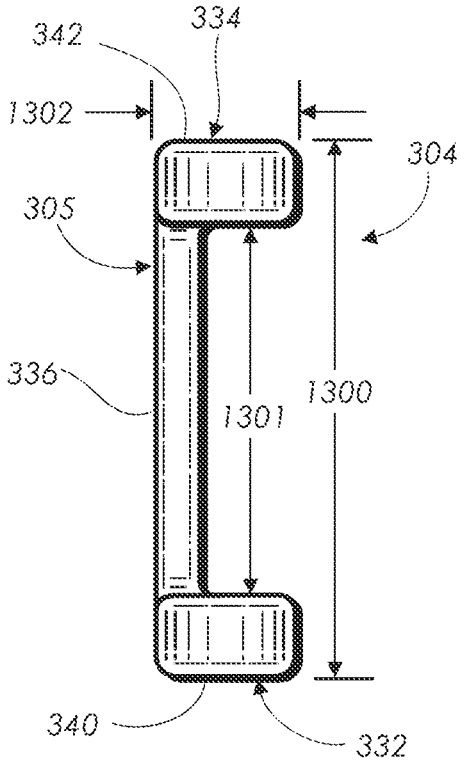
FIG. 38 is a side view of the connector plate.
Figure 39:
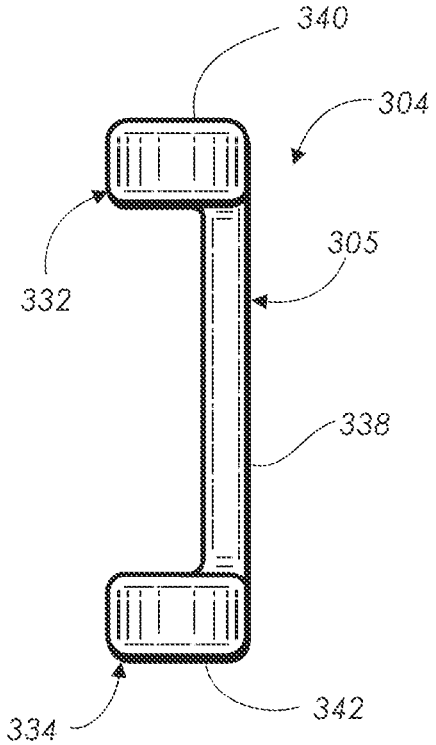
FIG. 39 is an opposing side view of the connector plate.

As shown in FIG. 38, the connector plate 304 may have an outer length 1300 between 30 mm to 50 mm corresponding to the overall length of the connector body 305, an inner length 1301 between 20 mm to 30 mm corresponding to the length of the connector body 305 defined between the first and second bridge portions 332 and 334, and a height 1302 between 3.5 mm to 5.5 mm corresponding to the height of the first and second bridge portions 332 and 334, As shown in FIG. the first channel 346 and the second channel 344 may have a height 1308 between 5 mm to 15 mm. As shown in FIG. 41, the first and second channels 346 and 344 may have a length 1310 between 20 mm to 30 mm.

Figure 33:
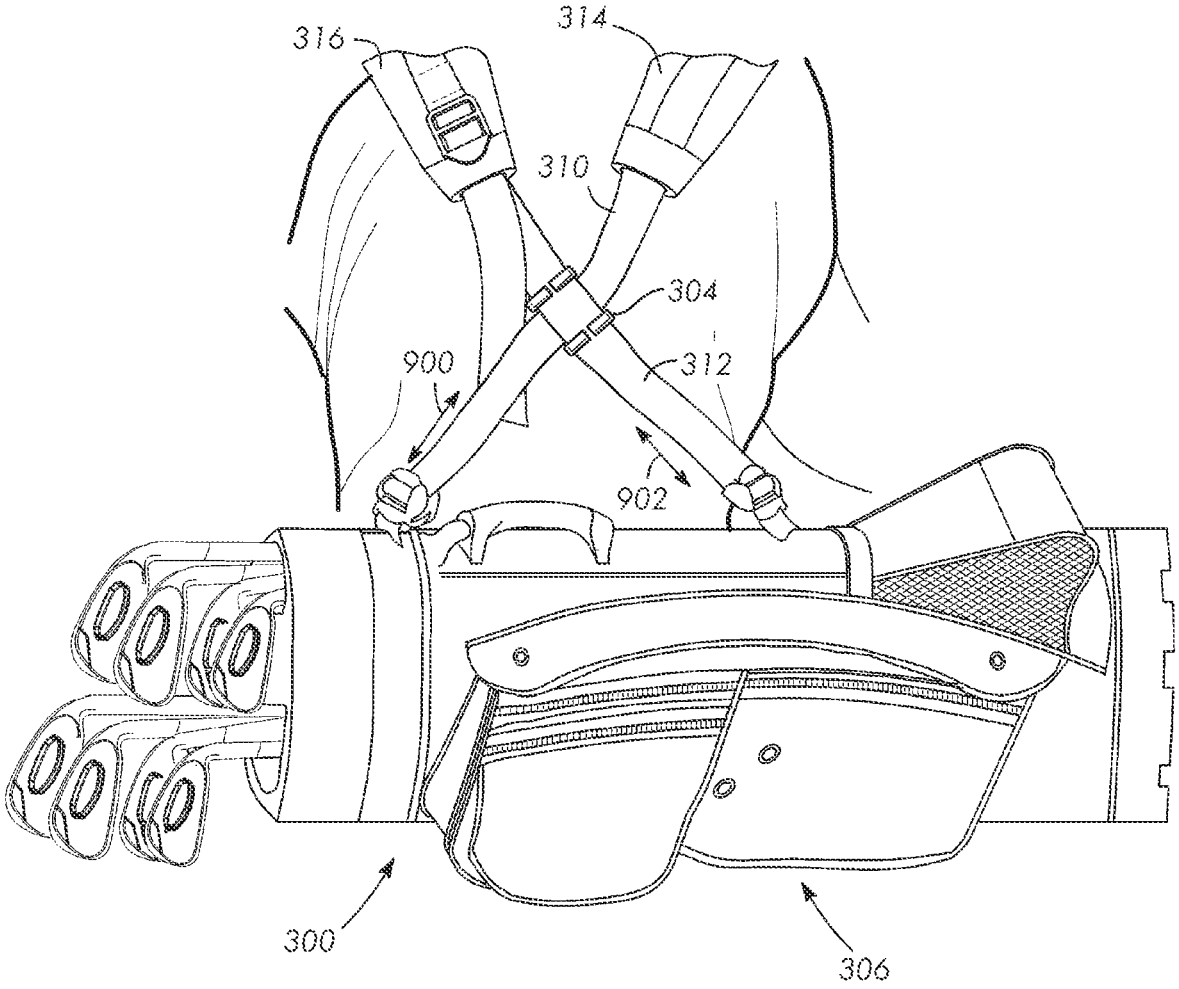
FIG. 33 is a perspective view of the golf bag with the self-adjustable carrying strap system of FIG. 29 engaged to an individual
Figure 34:
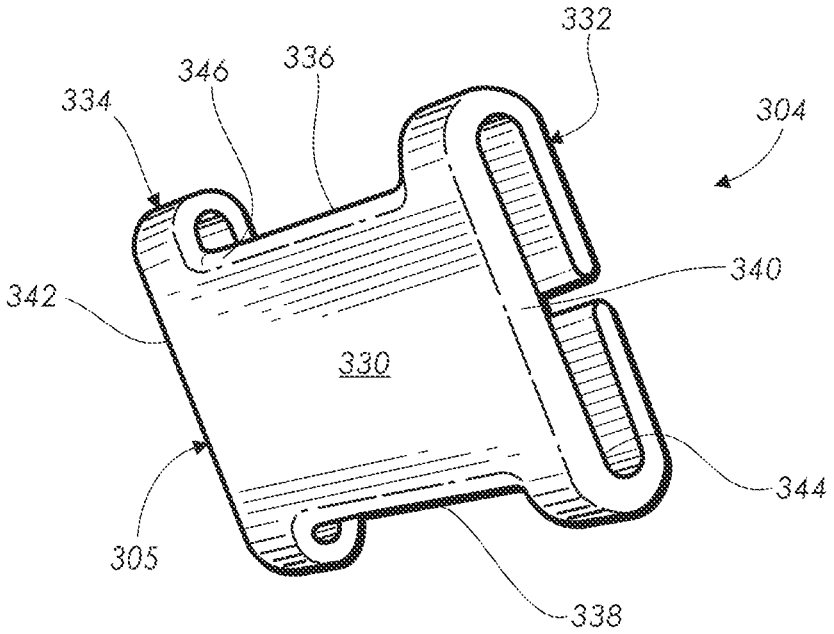
FIG. 34 is a perspective rear view of the connector plate.
Figure 35:
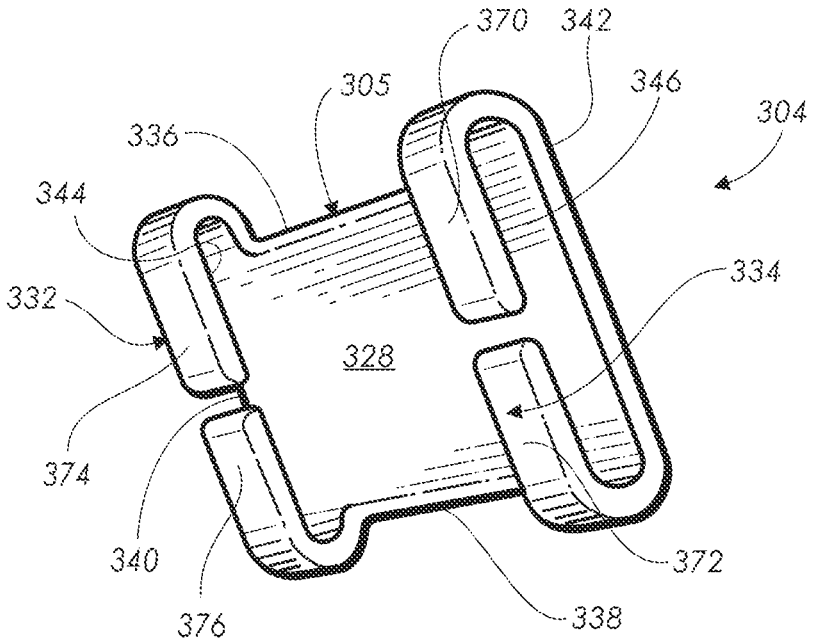
FIG. 35 is a perspective front view of the connector plate.
Figure 36:
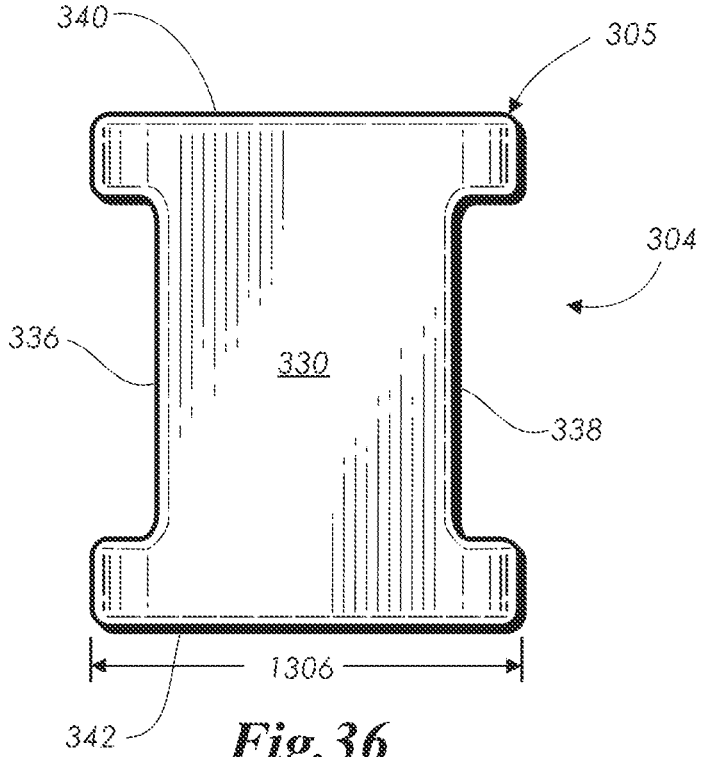
FIG. 36 is a rear view of the connector plate.

As shown in FIGS. 31 and 33, the golf bag 300 includes a generally tubular elongated body 306 (FIG. 33) defining a first upper portion 356, a second lower portion 358, and a third middle portion 357. In one embodiment, the golf bag 300 is a carrying bag that is adapted to be carried by an individual and configured to carry one or more golf clubs. The golf bag 300 further includes the self-adjustable carrying strap system 302 having the first carrying strap 310 and the second carrying strap 312 that overlap each other in a crossing fashion along the connector plate 304 as described above. The connector plate 304 of the golf bag 300 is configured to allow the first and second carrying straps 310 and 312 to be self-adjustable without any manual adjustment required by the individual such that the first and second carrying straps 310 and 312 freely move relative to each other along either axis 926 for the first carrying strap 310 or axis 928 for the second carrying strap 312 in response to the shifting of the golf bag 300 as shown in FIG. 42.

Figure 43:
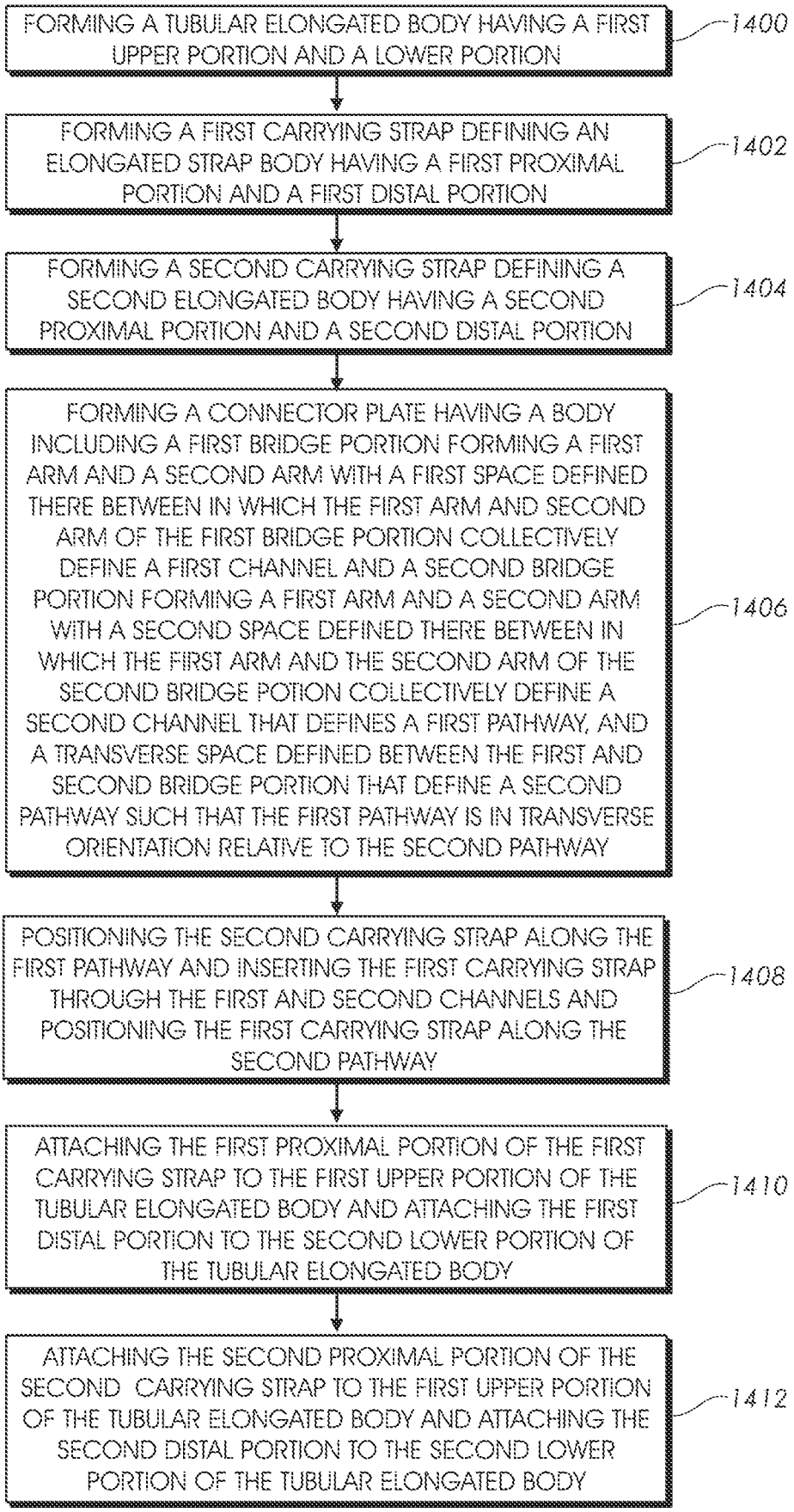
FIG. 43 is a flow chart illustrating a method for manufacturing a golf bag having the self-adjustable carrying strap system of FIG. 29.

A method of manufacturing the bag 315 with the self-adjustable carrying strap system 302 is illustrated in FIG. 43. At block 1400 forming the tubular elongated body 306 having a first upper portion 356 and a second lower portion 357. At block 1402, forming a first carrying strap 310 having a first proximal portion 318 and a first distal portion 320. At block 1404, forming a second carrying strap 312 defining a first proximal portion 322 and a second distal portion 324. At block 1406, forming a connector plate 304 having a connector plate body 305 including a first bridge portion 332 forming a first arm 374 and a second arm 376 with a first space 382 defined there between in which the first arm 374 and the second arm 376 of the first bridge portion 332 collectively defining a first channel 346 and the second bridge portion 334 forming a first arm 370 and a second arm 372 with a second space 380 defined there between in which the first arm 370 and the second arm 372 of the second bridge portion 334 collectively define a second channel 344 wherein the first and second bridge portions 332 and 334 are in parallel orientation to one another as well as adjacent or proximate to the same plane 806 as the front surface 328 of the connector plate body 305. In addition, the first and second bridge portions 332 and 334 collectively define a first pathway and a transverse space 331 defined between the first and second bridge portions 332 and 334 that define the second pathway such that the first pathway is in transverse orientation relative to the second pathway. At block 1408, positioning the second carrying strap 312 along the first pathway and inserting the first carrying strap 310 through the first and second channels 344 and 346 and positioned along the second pathway. In this intersecting arrangement, the first carrying strap 310 and the second carrying strap 312 overlap each other in a transverse orientation. At block 1410, attaching the first proximal portion 318 of the first carrying strap 310 to the upper portion 356 of the bag 315 and attaching the first distal portion 320 to the lower portion 358 of the bag 315. At block 1412, attaching the second proximal portion 322 of the second carrying strap 312 to the upper portion 356 of the bag 315 and attaching the second distal portion 324 to the lower portion 358 of the bag 315. In addition, the first and second carrying straps 310 and 312 may move freely relative to each other such that each respective first and second carrying strap 310 and 312 automatically adjusts without manual intervention by the individual whenever the bag 315 shifts as the individual is carrying the bag 315.

In one embodiment, the connector plate body 305 may be formed using a molding process, a stamping process, a milling process, and a combination thereof. In some embodiments, the connector plate body 305 may be made from a plastic, metal, or a composite material. The method of manufacture described above may be used to manufacture the golf bag 300 with the self-adjustable carrying strap system 302 as illustrated in FIG. 43.

It should be understood from the foregoing that, while particular embodiments have been illustrated and described, various modifications can be made without departing from the spirit and scope of the invention as will be apparent to those skilled in the art. Such changes and modifications are within the scope and teachings of this invention as defined in the claims appended hereto.

The invention claimed is:

1. A self-adjustable carrying strap system for use with carrying a bag, the system comprising:

a first carrying strap;

a second carrying strap; and a connector plate comprising a connector plate body having a rear surface and a front surface, the front surface defining a plane;

the connector plate body including a first bridge and a second bridge extending over a footprint of the front surface and offset from the front surface;

the first bridge defining a first channel having a first arcuate end and a second arcuate end coupled to the front surface, and a straight portion coupled to the first arcuate end and the second arcuate end, wherein the straight portion of the first bridge is substantially parallel with the front surface;

the second bridge defining a second channel having a first arcuate end and a second arcuate end coupled to the front surface, and a straight portion coupled to the first arcuate end and the second arcuate end, wherein the straight portion of the second bridge is substantially parallel with the front surface;

wherein the first channel and the second channel define a first linear pathway along the front surface;

wherein the first bridge and the second bridge are configured to receive the first carrying strap above the front surface;

wherein the first carrying strap while in the first linear pathway is substantially parallel to the front surface without bends or turns in any direction;

wherein the first and second channels define a height of the first and second bridges above the front surface in a range of 5 mm to 15 mm;

wherein a transverse space is defined between the first bridge and the second bridge and forms a second linear pathway in a transverse orientation relative to the first linear pathway;

wherein the second carrying strap while in the second linear pathway is substantially parallel to the front surface without bends or turns in any direction;

wherein the second carrying strap in the second linear pathway passes between the first carrying strap and the front surface of the connector plate;

wherein the first bridge is defined at a first side edge of the connector plate and the second bridge is defined at a second side edge of the connector plate opposite the first side edge;

wherein the first pathway and the second pathway are defined entirely above the plane defined by the front surface;

wherein the first and second carrying straps overlap each other along the front surface of the connector plate;

wherein the first linear pathway lies along a longitudinal axis;

wherein the second linear pathway lies along a latitudinal axis;

wherein the connector plate avoids pinching or clasping the first and second carrying straps allowing them to move without hindrance such that the first carrying strap can move without hindrance approximately along the first linear pathway in a direction of the longitudinal axis, and the second carrying strap can move without hindrance approximately along the second linear pathway in a direction of the latitudinal axis.

2. The system of claim 1, wherein the first carrying strap is inserted through the first channel and the second channel when engaged to the connector plate.

3. The system of claim 2, wherein the bag comprises at least one of a golf bag, a tool bag, a book bag, a backpack, a duffel bag, a computer bag, a suitcase, or a rucksack.

4. The system of claim 1, wherein the connector plate defines a first side, second side, third side and fourth side, wherein the first side and second side are substantially equal in length and the third side and fourth side are substantially equal in length.

5. A bag comprising:

an elongated body including a chamber configured to receive one or more golf clubs therein; and the self-adjustable carrying strap system of claim 4 connected to the elongated body.

6. The bag of claim 5, wherein the first carrying strap overlaps the second carrying strap in a transverse orientation relative to each other.

7. The bag of claim 5, wherein the first bridge and the second bridge each define a first length that is substantially the same as a second length defined between the first bridge and the second bridge.

8. The bag of claim 5, wherein a width of the transverse space is substantially equal to a width of the second carrying strap.

9. The bag of claim 5, wherein the first and second bridges are substantially parallel to each other.

10. The system of claim 1, wherein the first side and second side are greater in length relative to the third side and fourth side, respectively.

11. The system of claim 1, wherein a width of the transverse space is substantially equal to a width of the second carrying strap.

12. The system of claim 1, wherein the first and second bridges are substantially parallel to each other.

* * * * *